US006926215B2

(12) United States Patent
Elliott

(10) Patent No.: US 6,926,215 B2
(45) Date of Patent: Aug. 9, 2005

(54) HAMMERMILL

(75) Inventor: James C. Elliott, Spartanburg, SC (US)

(73) Assignee: Rader Companies, Inc., Alpharetta, GA (US)

( * ) Notice: Subject to any disclaimer, the term of this patent is extended or adjusted under 35 U.S.C. 154(b) by 120 days.

(21) Appl. No.: 10/150,031

(22) Filed: May 17, 2002

(65) Prior Publication Data

US 2002/0170993 A1 Nov. 21, 2002

Related U.S. Application Data

(60) Provisional application No. 60/292,213, filed on May 17, 2001.

(51) Int. Cl.[7] ..... B02C 13/282
(52) U.S. Cl. ..... 241/188.1; 241/194
(58) Field of Search ..... 241/188.1, 194, 241/195

(56) References Cited

U.S. PATENT DOCUMENTS

| | | | | |
|---|---|---|---|---|
| 807,136 | A | * 12/1905 | Spurgin | |
| 1,047,356 | A | * 12/1912 | Williams | |
| 1,647,555 | A | * 11/1927 | Wells | 241/188.1 |
| 3,214,105 | A | * 10/1965 | Owens et al. | 241/154 |
| 3,627,212 | A | 12/1971 | Stanton | 241/73 |
| 3,868,064 | A | 2/1975 | Coulter et al. | 241/134 |
| 3,966,126 | A | 6/1976 | Werner | 241/18 |
| 4,002,301 | A | 1/1977 | Shurtleff | 241/48 |
| 4,066,216 | A | 1/1978 | Waldrop et al. | 241/190 |
| 4,166,583 | A | 9/1979 | Ruckstuhl | 241/73 |
| 4,214,716 | A | 7/1980 | Jadouin | 241/186 R |
| 4,702,426 | A | * 10/1987 | Citterio | |
| 5,022,593 | A | 6/1991 | Stelk | 241/194 |
| 5,062,575 | A | 11/1991 | Barnabie et al. | 241/73 |
| 5,161,746 | A | 11/1992 | Bliss | 241/189.2 |
| 5,364,038 | A | 11/1994 | Prew | 241/189.1 |
| 5,377,919 | A | 1/1995 | Rogers et al. | 241/189.2 |
| 5,386,947 | A | 2/1995 | Omann | 241/41 |
| 5,535,954 | A | 7/1996 | Hudson et al. | 241/186.2 |
| 5,562,257 | A | 10/1996 | Graveman et al. | 241/190 |
| 5,598,981 | A | 2/1997 | Hellmich | 241/189.1 |
| 5,611,496 | A | 3/1997 | Fleenor | 241/166 |
| 5,628,467 | A | 5/1997 | Graveman | 241/88.4 |
| 5,842,653 | A | 12/1998 | Elliott et al. | 241/88.1 |
| 5,904,306 | A | 5/1999 | Elliott et al. | 241/88.1 |
| 5,938,131 | A | 8/1999 | Thom, Jr. et al. | 241/73 |
| 5,947,396 | A | * 9/1999 | Pierce | 241/32 |
| 5,950,945 | A | 9/1999 | Schaller | 241/189.1 |
| 5,976,436 | A | 11/1999 | Livesley et al. | 264/113 |
| 6,045,072 | A | 4/2000 | Zehr | 241/189.1 |
| 6,325,306 | B1 | 12/2001 | Gacanich et al. | 241/15 |

OTHER PUBLICATIONS

"No–Nife" Hogs, Williams, Bulletin 844, Index C, Catalog.
Falcon Hog™ Waste Wood Processor, Dingwell's, Catalog.
High Inertia Hog, West Salem Machinery, Catalog.
Wood/Bark Hogs and Shredders, Jeffrey, Catalog 24596.

* cited by examiner

*Primary Examiner*—Mark Rosenbaum
(74) *Attorney, Agent, or Firm*—Needle & Rosenberg, PC.

(57) ABSTRACT

A hammermill having a housing, a rotor assembly, a first plurality of hammers, and a first attrition plate assembly is provided to reduce oversized particulate material to a desired size. The housing has a sidewall that extends between an inlet end and an discharge end which defines an enclosed work space. The rotor assembly is disposed within the housing for rotation about a longitudinal axis of the housing. The first plurality of hammers is coupled to the rotor assembly and is disposed within the enclosed work space. The first attrition plate assembly has a generally circular configuration and is removably secured to the sidewall within the enclosed work space of the housing. The first attrition plate assembly is arranged such that at least a portion of each hammer of the first plurality of hammers is spaced from and overlies a portion of the first attrition plate assembly so that the hammers and the attrition plate assembly cooperate to reduce particulate material to a desired size and to urge the particulate material toward the discharge end of the housing.

133 Claims, 10 Drawing Sheets

HAMMERMILL

This application claims priority to the U.S. provisional application 60/292,213, filed May 17, 2001, which is incorporated herein in its entirety.

BACKGROUND OF THE INVENTION

1. Field of the Invention

The present invention relates to impact grinders, hammermills, or the like, and particularly to a screenless hammermill that can be used to reduce the size of material to a desired dimension.

2. Background Art

A number of different industries rely on impact grinders or hammermills to reduce materials to a smaller size. Hammermills are often used to process forestry and agricultural products as well as to process minerals, and for recycling materials. Specific examples of materials processed by hammermills include ore, limestone, coal, railroad ties, lumber, limbs, brush, grains, and even automobiles. Once reduced to the desired size, the material passes out of the housing of the hammermill for subsequent use and further processing. Exemplary embodiments of hammermills are disclosed in U.S. Pat. Nos. 5,904,306; 5,842,653; 5,377,919; and 3,627,212, all of which are incorporated herein in their entireties.

Hammermills—also generally referred to as crushers or shredders—typically include a steel housing or chamber containing a plurality of hammers mounted on a rotor and a suitable drive train for rotating the rotor. As the rotor turns, the correspondingly rotating hammers come into engagement with the material to be comminuted or reduced in size. Hammermills typically use grates formed into and circumscribing a portion of the interior surface of the housing. The size of the particulate material is controlled by the size of the screen apertures against which the rotating hammers force the material. Unfortunately, in prior art hammermills, material can "short circuit" or by-pass the hammers by being forced through the apertures in the grates or screens before being thoroughly processed or sized.

Furthermore, the prior art grates or screens can become restricted and plugged with the materials being reduced, which, in turn, reduces the throughput and efficiency of the hammermill. In particular, wood that has a "stringy bark," such as poplar, hickory, and eucalyptus, is very problematic for the grates and thus is not effectively reduced using a prior art hammermill because materials tend to straddle the apertures and to build up therein, resulting in the apertures becoming plugged or partially deformed which does not allow material of a desired size to pass through the plugged or deformed aperture(s) and reduces throughput and efficiency of the hammermill. Thus, the higher energy costs and the cost of the need for frequent repair and replacement of the grate or screen represents a significant ongoing financial outlay.

There is a need, therefore, for an improved hammermill adapted for use with any desired materials to be processed, and which will increase the likelihood of the materials passed therethrough being thoroughly processed, at least to the extent desired.

SUMMARY

The present invention provides an improved hammermill which overcomes some of the design defects of the known hammermills. The hammermill of the present invention comprises a housing, a rotor assembly disposed within the housing for rotation about a longitudinal axis of the housing, a plurality of hammers coupled to the rotor assembly, and an attrition plate assembly secured to a sidewall of the housing. The housing has an inlet end defining an inlet opening, a discharge end, with the longitudinal axis of the housing extending therebetween. The sidewall of the housing extends between the inlet end and the discharge end. The housing further defines a primary reduction chamber and an adjoining secondary reduction chamber. In one embodiment, the sidewall of the housing and the inlet opening define a partially enclosed work space in the primary reduction chamber, and, in the secondary reduction chamber, the sidewall of the housing defines an enclosed work space.

In one aspect, the plurality of hammers is disposed in both of the primary and secondary reduction chambers. Each hammer in the plurality of hammers is selected from a group consisting of fixed hammers, swing hammers, of a combination thereof. In another aspect, each hammer that is disposed in the primary reduction chamber comprises a swing hammer, and each hammer that is disposed in the secondary reduction chamber is selected from a group consisting of fixed hammers, swing hammers, of a combination thereof.

The attrition plate assembly is removably secured to the sidewall of the housing within the primary and secondary reduction chambers so that the hammers are spaced from and overlie a portion of the attrition plate assembly. In this overlying and spaced relationship, the hammers and attrition plate assembly cooperate to urge particulate material toward the discharge end of the housing. Preferably, the portion of the attrition plate assembly that is secured within the secondary reduction chamber has a generally circular configuration and defines a substantially continuous work surface. Similarly, the portion of the attrition plate assembly that is removably secured within the primary reduction chamber has a semi-circular configuration that, while defining a discontinuous work surface, is generally continuous along its arcuate length.

BRIEF DESCRIPTION OF THE FIGURES OF THE DRAWINGS

These and other features and aspects of the present invention will become better understood with reference to the following description, appended claims, and accompanying drawings, where:

DETAILED DESCRIPTION OF THE INVENTION

Figure 1A:
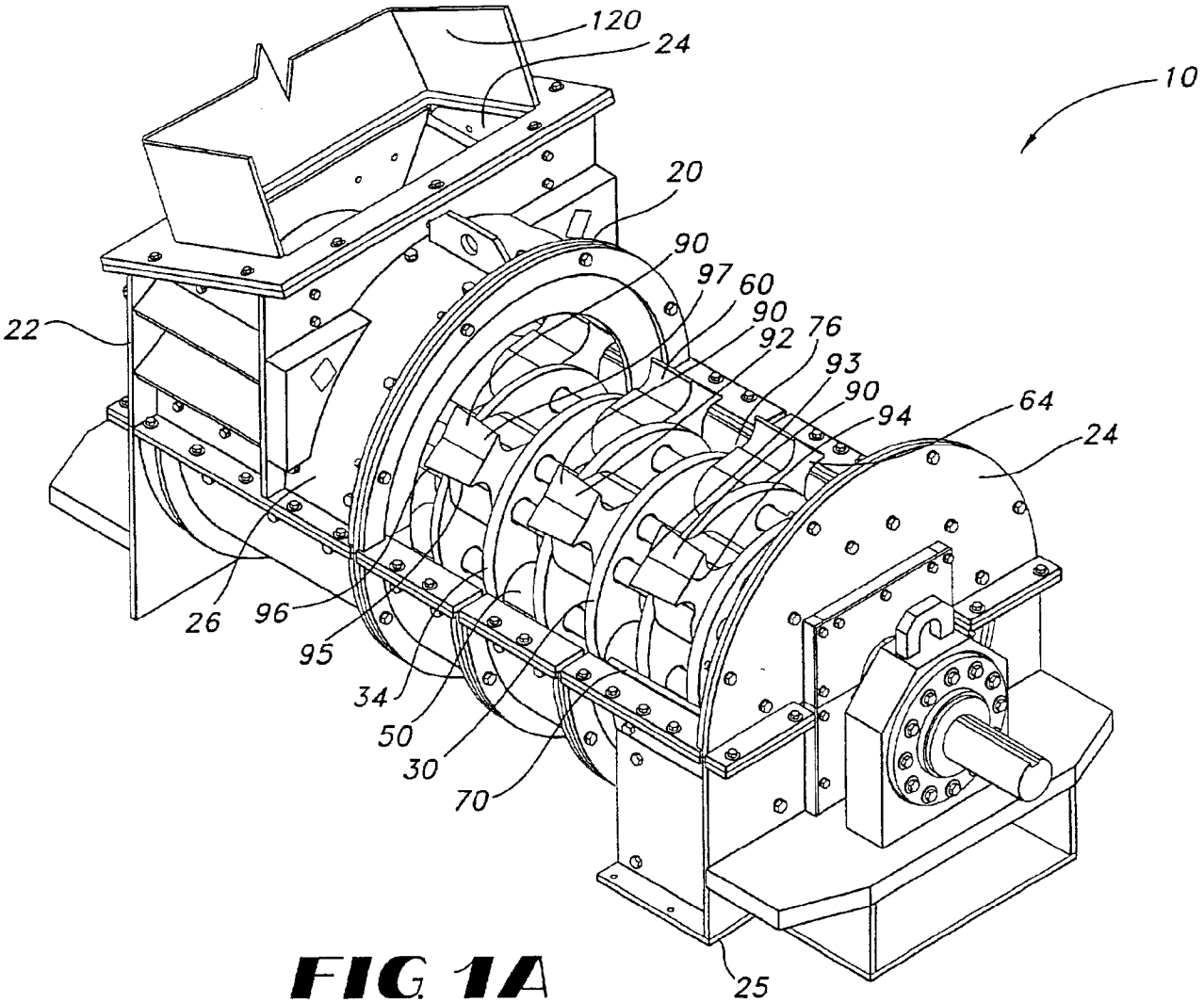
FIG. 1A is a perspective view of a preferred embodiment of the present invention with a portion of a sidewall of the hammermill removed.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

The present invention comprises a hammermill 10 as shown generally in FIGS. 1A–10. The hammermill 10 of the present invention is adapted for reducing wood or similar fibrous materials (i.e., for use as a hammermill 10 which is typically referred to as a hog or a wood/bark hog), but one skilled in the art will appreciate that the design features of the present invention are applicable to comminute other types of friable materials, such as coal, minerals, agricultural products, and the like.

Referring first to FIGS. 1A–4, an exemplary embodiment of the hammermill 10 of the present invention is shown. In one embodiment, the hammermill 10 has an elongate housing 20 with an inlet end 22 for receiving oversized particulate materials, a spaced discharge end 24 for exiting desired sized particulate materials, and a sidewall 26 extending between the inlet end 22 and the discharge end 24. The sidewall 26 may have a substantially uniform curvature, for example, the sidewall 26 may be cylindrical, or otherwise form a cylinder. An inlet opening 23 is defined in the sidewall 26 of the housing 20 proximate the inlet end 22 thereof and a discharge opening 25 is defined in the sidewall 26 of the housing 20 proximate the discharge end 24 thereof. In one example, the inlet opening 23 is formed above the longitudinal axis of the housing 20 and the discharge opening 25 is positioned below the longitudinal axis of the housing 20.

As shown, the hammermill 10 also includes a rotor assembly 30 that is disposed within the housing 20 for reducing the oversized particulate materials to the desired size particulate materials. The rotor assembly 30 is adapted for rotation about the longitudinal axis of the housing 20. The rotor assembly 30 is conventional and may include a rotatable shaft 32 that extends along the longitudinal axis and conventional support means extending radially from the shaft 32. The support means may include, for example, conventional disks 34 and support rods 36 extending longitudinally through the disks 34 parallel to the rotor shaft 32, or conventional spiders.

One design feature of the exemplary embodiment is the flow of the particulate materials being comminuted, such that the particulate materials flow longitudinally through the length of the housing 20. As used herein, "longitudinally" refers to the direction that the rotor assembly 30 extends and, more specifically, to the longitudinal axis of the hammermill 10 housing 20 that traverses through the center of the rotor shaft 32 and along its length. As will be noted in FIGS. 1A–2, the particulate materials to be reduced are fed into one longitudinal end of the hammermill 10 and, while being processed, concurrently traverse longitudinally downstream through the hammermill 10 to be ultimately discharged from the opposed discharge end 24 of the housing 20.

In comparison, typical prior art systems, such as those disclosed in U.S. Pat. Nos. 5,904,306, 5,377,919, and 3,627,212, feed particulate materials into an infeed opening that extends along the entire, or substantially the entire, longitudinal length of the processing section of the hammermill. As one skilled in the art will appreciate, hammermills that feed particulate materials along the entire longitudinal length typically discharge the processed particulate materials out the bottom of the housing through sizing grates or plates with sizing holes. The discharge area is usually restricted to 180° or less of the housing and will thus "recycle" particulate material that is not yet sized to pass through the discharge openings or that cannot otherwise pass through the openings because of the sheer volume of particulate material being processed at the moment. During the recycling of the particulate material, the particulate materials are moved about the rotor assembly and back to the lower reduction area such that very little size reduction of the particulate materials occurs, resulting in machine inefficiencies and energy being wasted. As discussed in more detail below, the preferred hammermill design of the present invention processes materials through approximately 270° about the rotor assembly 30 in a primary reduction chamber 40 and a full 360° about the, rotor assembly 30 in a secondary reduction chamber 50, allowing for a more efficient and smaller machine.

Still referring back to FIGS. 1A–4, the housing 20 of the hammermill 10 further defines the primary reduction chamber 40 and the adjoining secondary reduction chamber 50. The sidewall 26 of the housing 20 and the inlet opening 23 define a partially enclosed work surface in the primary reduction chamber 40. Similarly, the sidewall 26 of the housing 20 defines an enclosed work space in the secondary reduction chamber 50. In the primary reduction chamber 40, the hammermill 10 is enclosed for approximately 180° to 320° around its interior periphery or circumference, in which the portion of the housing 20 not enclosed forms the inlet opening 23 to feed particulate material into the interior of the housing 20.

In the secondary reduction chamber 50, the hammermill 10 is completely enclosed around its interior periphery or circumference. As one skilled in the art will appreciate, prior art hammermills do not include a secondary reduction chamber. That is, prior art designs only use the equivalent of a primary reduction chamber 40 because all portions of the housing 20 that reduce the particulate materials are typically open to allow feeding of the particulate materials directly to that longitudinal section of the housing 20.

The hammermill 10 also includes at least a first plurality of hammers 60 coupled to the rotor assembly 30 that cooperates with a first attrition plate assembly 70 that is removably secured to the sidewall 26 of the housing 20. The first plurality of hammers 60 is disposed intermediate the inlet end 22 and the discharge end 24 of the housing 20 and within the secondary reduction chamber 50 thereof. The first attrition plate assembly 70 has a generally circular configuration and is also disposed intermediate the inlet end 22 and the discharge end 24 of the housing 20, and within the secondary reduction chamber 50 of the housing 20. The first attrition plate assembly 70 thus defines a substantially continuous first work surface 80 in the enclosed work space that extends about the rotor assembly 30 and the hammers. Preferably, the continuous first work surface 80 has a generally cylindrical shape and encloses the first plurality of hammers 60 that are disposed in the secondary reduction chamber 50. Thus, in use, at least a portion of each hammer 90 of the first plurality of hammers 60 closely overlies a portion of the first attrition plate assembly 70 so that the hammers of the first plurality of hammers 60 cooperate with the first work surface 80 of the first attrition plate assembly 70 to form the desired sized particulate material and to urge the particulate material toward the discharge end 24 of the housing 20.

The hammermill 10 may also include a second plurality of hammers 62 coupled to the rotor assembly 30 that is disposed proximate the inlet end 22 of the housing 20 and adjacent the first plurality of hammers 60. The second plurality of hammers 62 is positioned within the primary reduction chamber 40 of the housing 20. In one example, at least a portion of the second plurality of hammers 62 is positioned so that it underlies the inlet opening 23 of the housing 20. In this embodiment, the housing 20 includes a second attrition plate assembly 72 that has a generally semi-circular configuration extending about the rotor assembly 30 and the hammers. The second attrition plate assembly 72 cooperates with the second plurality of hammers 62. The second attrition plate assembly 72 defines a discontinuous second work surface 82, i.e., a semi-circular work surface, that is, however, generally continuous along its arcuate length. The second attrition plate assembly 72 is removably secured within the housing 20 adjacent to the inlet end 22 of the housing 20 and the first attrition plate assembly 70, i.e., within the primary reduction chamber 40. At least a portion of each hammer 90 of the second plurality of hammers 62 closely overlies a portion of the second attrition plate assembly 72 so that the hammers of the second plurality of hammers 62 cooperate with the second work surface 82 of the second attrition plate assembly 72 for initial commutation of the oversized particulate materials and to urge the particulate material towards the discharge end 24 of the housing 20, and, more particularly, to urge the particulate material longitudinally downstream toward the first plurality of hammers 60 and the first attrition plate assembly 70.

As one skilled in the art will appreciate, the first and second attrition plate assemblies 70, 72 together form a composite attrition plate assembly 74 that is disposed within both of the primary and the secondary reduction chambers 40, 50, respectively. Similarly, the first and the second plurality of hammers 60, 62 together form a composite plurality of hammers 64 disposed within both of the respective primary and secondary reduction chambers 40, 50. As one skilled in the art will further appreciate, each hammer 90 is conventionally coupled to the support means of the rotor assembly 30.

Each hammer 90 has an outer tip 91 which defines a hammer rotation radius H, about the longitudinal axis of the housing 20 of the hammermill 10. The first and second work surfaces 80, 82 of the respective first and second attrition plate assemblies each have a radius of curvature $P_r$ about the longitudinal axis of the housing 20 that is greater than the hammer rotation radius. Preferably, the first and second attrition plate assemblies of the attrition plate assembly 74 are arranged such that at least of portion of the outer tip 91 of each hammer 90 is spaced from the highest portion of the respective first and second work surfaces 80, 82 in the range of from 0.125 to 1.5 inches. More preferably the hammers 90 are spaced from the work surfaces from between 0.06 to 2.0 inches, and, still more preferably, from between 0.01 to 3.0 inches.

One skilled in the art will appreciate that the completely enclosed secondary reduction chamber 50 will comminute the particulate materials more efficiently than the primary reduction chamber 40 because the particulate materials being comminuted do not have any reprieve from the rotating hammers 90 which continuously "sandwich" and/or "scissor" the particulate material between the first attrition plate assembly 70 and the rotating hammers of the first plurality of hammers 60.

As known, each hammer 90 of the plurality of hammers 64 may comprise a swing hammer. In such an example, all of the hammers in both of the primary and secondary reduction chambers 40, 50 may, respectively, comprise swing hammers. In an alternate example, each of the hammers 90 of both the first and second plurality of hammers 60, 62 may be selected from a group consisting of fixed hammers, swing hammers, or a combination thereof. Thus, swing and/or fixed hammers may be disposed in the primary and secondary reduction chambers 40, 50 of the hammermill 10, as desired.

Prior art hammermills typically use only swing hammers, which are hammers that are pivotally mounted to the rotor assembly and are oriented outwardly from the center of the rotor assembly by centrifugal force. Swing hammers are often used instead of rigidly connected hammers in case tramp metal, foreign objects, or other non-crushable matter enters the housing with the particulate material to be reduced, such as wood and bark. If rigidly attached hammers contact such a non-crushable foreign object within the housing, the consequences of the resulting contact may be severe. Swing hammers, in comparison, provide a "forgiveness" factor because they will lay back out of position when striking non-crushable foreign objects.

In one preferred example, the hammermill 10 of the present invention uses a combination of rigid and swing hammers. The hammers 90 that are disposed in the primary reduction chamber 40 are swing hammers to account for potential hazards, such as the inadvertent introduction of tramp metal or overfeeding. In comparison, the hammers 90 that are disposed in the secondary reduction chamber 50 of the hammermill 10 are selected from the group comprising fixed hammers, swing hammers, or a combination thereof Preferably, the hammers 90 that are disposed in the secondary reduction chamber 50 are rigid hammers, which are fixedly and stationarily positioned relative to the rotor shaft 32 and generally extend normal to the rotor shaft 32. The rigid hammers increase the efficiency of the hammermill 10 because there is increased energy transferred from the rotor assembly 30 to a rigid hammer as compared to the energy transfer to a swing hammer that is pivotally mounted to the rotor assembly 30.

One skilled in the art will appreciate that although swing hammers are safer, they become less efficient at higher throughputs because they "lay back" with the increased volume of particulate material being processed, something that does not occur with rigid hammers. In addition, one skilled in the art will further appreciate that the increased energy transfer between the rotor assembly 30 and the rigid hammers 90, coupled with the secondary reduction chamber 50 having a contiguous work surface, makes the secondary reduction chamber efficient. However, as noted above, it is within the scope of the present invention to use the same "category" of hammer throughout the longitudinal length of the hammermill 10, i.e., all swing hammers or all rigid hammers. It is also contemplated that, regardless of the categories of hammers 90 included, either to stagger or not to stagger the hammers, for example, the hammers may be staggered in a helical pattern.

For effective reduction in hammermills 10 using swing hammers, the rotor speed must produce sufficient centrifugal force to hold the hammers in the fully extended position while also having sufficient hold out force to effectively reduce the material being processed. Depending on the type of material being processed, the minimum hammer tips speeds of the hammers are usually 6,000 to 11,000 feet per minute ("FPM"). In comparison, the maximum speeds depend on shaft and bearing design, but usually do not exceed 15,000 FPM. In special high-speed applications, the hammermills can be designed to operate up to 21,000 FPM. Because rigid or fixed hammers do not depend on centrifugal force to hold them in position, the hammers can be operated at much lower speeds and, depending on the materials being reduced and the application requirements, remain effective. However, tip speeds of more than 2,000 FPM might be appropriate for some applications.

Referring to FIGS. 5A–7B, each of the respective first and second attrition plate assemblies comprises a plurality of adjoining attrition impact plates 75. Preferably, each attrition impact plate 75 has a curvilinear inner surface 76. In use, the individual attrition impact plates 75 are positioned along or on the interior surface of the housing 20 of the hammermill 10 so that the interior surface of the hammermill 10 may be partially or completely lined with the attrition impact plates 75. In one example, at least two attrition impact plates 75 are positioned so that the curvilinear inner surfaces 76 of the adjoining attrition impact plates form the contiguous first work surface 80 within the secondary reduction chamber 50. In another example, at least two attrition impact plates 75 are positioned so that the curvilinear inner surfaces 76 of the adjoining attrition impact plates form the second work surface 82 within the primary reduction chamber 40.

At least one of the attrition impact plates 75 preferably has discontinuities formed on or defined within an otherwise smooth arcuate surface in order to increase the shearing action imparted by the rotating hammers. The attrition impact plates 75 having such discontinuities have at least one elevated male protrusion 78 extending from the inner surface 76 of the impact plate to form "positive" discontinuous surfaces that act as cutting edges. Alternately, the attrition impact plates could have at least one female depression 79 in the inner surface 76 to form a recessed or "negative" discontinuous surface. The elevated surface of the attrition impact plate having the male protrusions could, for example, be a casting, while the recessed surface having the female depression 79 could, for example, be a casting or be made from wear resistant plate steel as a two plate laminate, in which the bottom plate protects the sidewall 26 of the housing 20 of the hammermill 10 from wear.

Each male protrusion 78 and female depression 79 defines a geometric shape. Any geometric shape is contemplated, such as, for example, circles, ovals, triangles, trapezoids, squares, arrows, elliptical shapes, rectangles, polygons, and the like. It is also contemplated that any combination of such geometric shapes may be used on any one or more of the attrition impact plates 75. Further, it is contemplated that various sizes of the selected geometric shapes may be used.

In addition, it is also contemplated that the attrition impact plates 75 will have a height difference between the low and high points of from one-eight (⅛) to one (1) inch. These preferred heights are sufficient to contribute to shearing the particulate material being processed, but are not deep enough so that tramp metal or other non-crushables can catch thereon and otherwise damage the rotating hammers 90 and/or the attrition impact plates 75. In comparison, because prior art units use either bar grates or screen plates for sizing, they are likely to suffer much more severe damage from tramp metal than the attrition impact plates 75 of the present invention.

Figure 6:
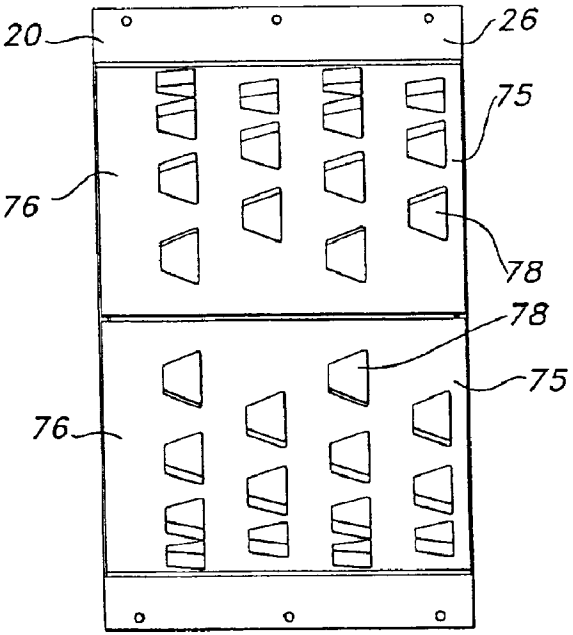
FIG. 6 is a top plan view of an alternate embodiment of an attrition impact plates used with the exemplary embodiment of the present invention, the attrition impact plates shown releasably engaged to a portion of the sidewall of the hammermill.
Figure 5A:
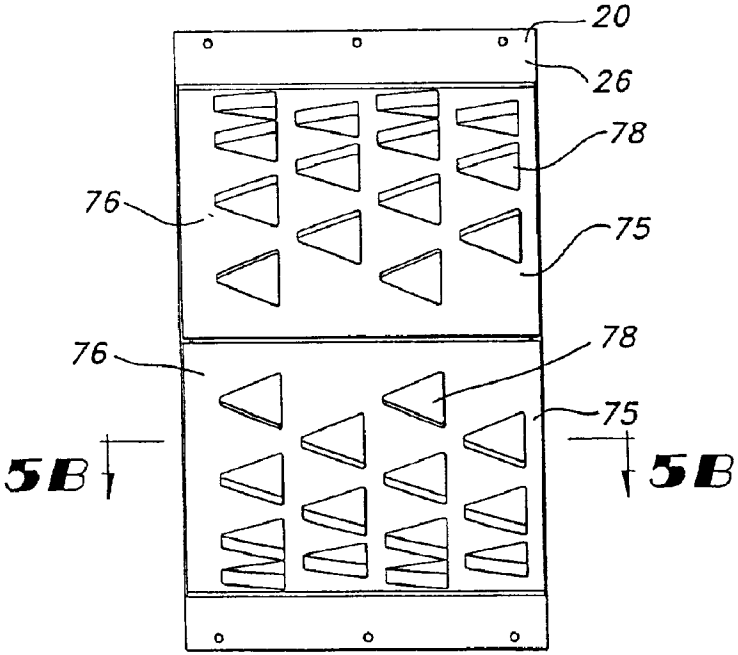
FIG. 5A is a top plan view of one embodiment of an attrition impact plates used with the exemplary embodiment of the present invention, the attrition impact plates shown releasably engaged to a portion of the sidewall of the hammermill.
Figure 5B:
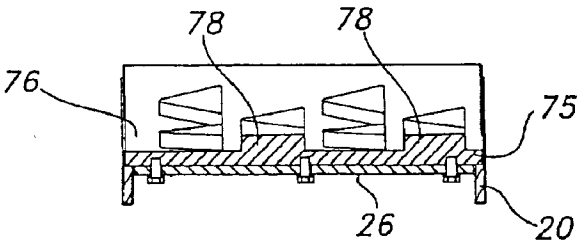
FIG. 5B is a side cross-sectional view taken along line 5—5 of FIG. 5A.

Referring now to FIG. 5A, one embodiment of the attrition impact plates 75 is shown having a plurality of triangle-shaped male protrusions. In conjunction, FIG. 5B shows a side cross-sectional view of the triangle-shaped protrusion attrition plates. In this example, each triangle-shaped male protrusion 78 has an apex that extends generally toward and in opposition to a portion of the discharge end 24 of the housing 20. Further, at least a portion of a base of each triangle-shaped male protrusion 78 is opposed to a portion of the inlet end 22 of the housing 20. Preferably, each triangle-shaped male protrusion 78 extends generally parallel to the longitudinal axis of the housing 20. Referring to FIG. 6, an example of an attrition impact plate having a plurality of trapezoid-shaped male protrusions 78 is shown. In this example, the trapezoid-shaped male protrusions are preferably oriented with respect to the inlet and discharge ends 22, 24 in like fashion to the triangle-shaped male protrusions described above.

In yet another example, the geometric shape selected for a male protrusion 78 extending from the attrition impact plates 75 may be a rectangle. Here, the male rectangular geometric shape forms a bar that extends along the width of each attrition impact plate. Preferably, in this example, each attrition plate assembly has a plurality of parallel bars that are spaced apart in the arcuate length direction and that extend parallel to the longitudinal axis of the housing 20.

In heretofore unknown fashion and as described in more detail below, the geometric shaped male protrusions and female depressions create a discontinuous surface over at least a portion of the inner surface 76 of the attrition impact plates 75 lining at least a portion of the interior of the housing 20 that act to assist in directing the material downstream toward the discharge end 24 of the housing 20. The geometric shaped male protrusions and female depressions also increase the efficiency of the downstream processing of particulate material. For example, a "scissors" action may be created between an impact end 92 of the hammer 90 and portions of the attrition impact plates' geometric-shaped protrusion and/or depression, which assists in reducing the particulate material being comminuted—particularly stringy wood particulate material.

Figure 7B:
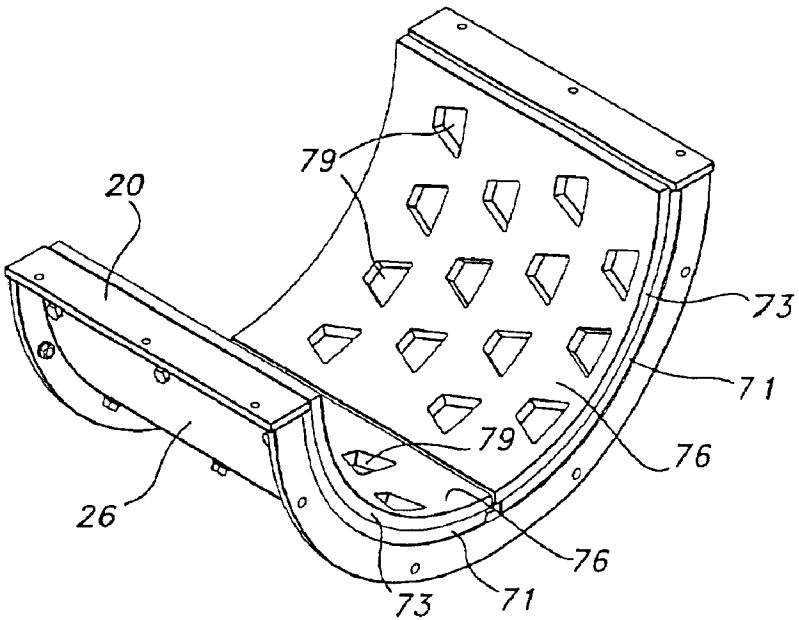
FIGS. 7A and 7B are perspective views of two alternate two-plate embodiments of the attrition impact plates.
Figure 7A:
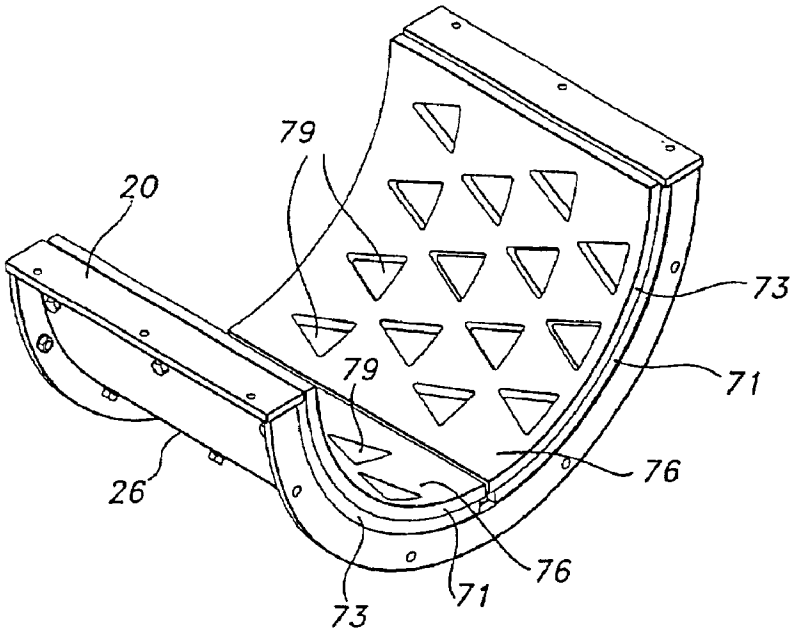

A consideration in using the attrition impact plates 75 having the geometric shapes thereon involves the replacement of the plates after they wear during normal operations of an extended duration. Referring now to FIGS. 7A and 7B, examples of an alternate embodiment using the female depression geometric shapes are shown. Here, there are two adjoining plates. The lower or outer plate 71 is solid, whereas the upper or inner plate 73 is formed of abrasion-resistant plate steel having "bum out" holes. These two plates are laminated together. This example is a low cost construction and provides for ease of installation which allows worn plates to be replaced inexpensively and quickly.

Referring to FIGS. 1A–4 and 8A–8C, the impact end 92 of each hammer 90 of the first and second plurality of hammers 60, 62 has a proximal end 93, a spaced distal end 94, and a pair of opposing side edges 95 extending between the proximal and distal ends of the hammer 90. The proximal end 93 of the impact end 92 of the hammer 90 has a first width $w_1$ and the distal end 94 has a second width $w_2$. In one example, the first width of the impact end of the hammer 90 may be substantially the same as the second width, however, in another example, the first width of the impact end of the hammer is greater than the second width so that at least one of the side edges 95 is tapered from the proximal end 93 to the distal end 94 of the impact end of the hammer 90. In use, each hammer 90 is positioned so that at least a portion of the proximal end 93 of the hammer impact end opposes the inlet end 22 of the housing 20.

The impact end 92 of the hammer 90 also has a bottom surface 97 that extends between the two side edges 95, at least a portion of which defines a concave shape. In addition, at least one of the side edges 95 of the impact end 92 of the hammer defines an impact edge 96 extending for at least a portion of the side edge 95. Preferably, both of the side edges have an impact edge 96 so that the hammermill 10 may be effectively operated when the rotor assembly 30 of the hammermill 10 is rotated in either a clockwise or a counter-clockwise direction.

Figure 8C:
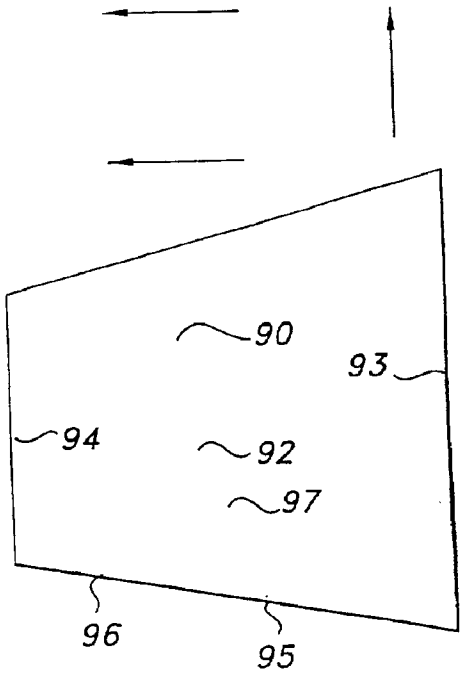
FIGS. 8A, 8B, and 8C are schematic top plan views of a hammer for use with the exemplary hammermill, in which the hammer moves or rotates in the direction of the three arrows shown in FIG. 8A.
Figure 8B:
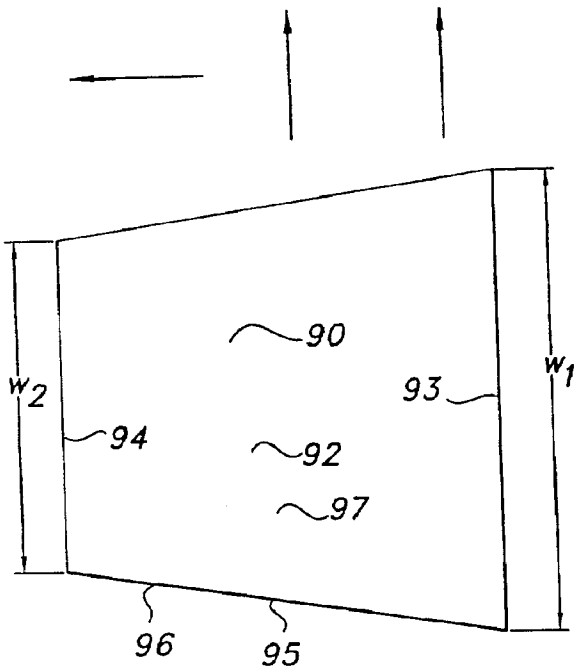
Figure 8A:
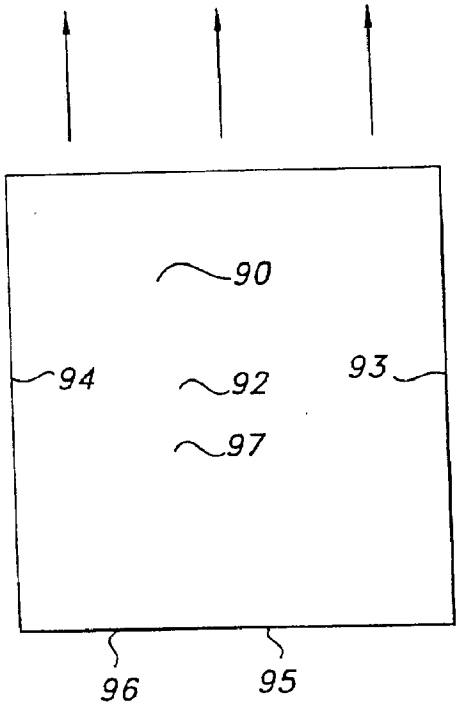

Referring now to FIGS. 8A–8C, in these top plan views the respective impact ends of the hammers are moving or rotating in the direction of the three arrows shown in FIG. 8A, the two arrows in FIG. 8B, and the single arrow in FIG. 8C. Starting with FIG. 8A, this example shows a side edge 95 of a square impact end, in which the first width of the impact end is substantially the same as the second width, in contact with the particulate material being reduced and the resulting force vectors that cause the struck particulate material to move in the same direction as the impact end of the hammer 90 is moving. As a result of being struck, there is no substantial sideways movement of the particulate material because the impact end 92 of the hammer does not have a tapered side edge 95. FIGS. 8B and 8C, in comparison, show a tapered side edge 95 on the impact end of the hammer. As represented by the arrows, the force vectors to the side are larger in FIG. 8B than FIG. 8A and largest in FIG. 8C.

As one skilled in the art will further appreciate, since the hammers are continuously rotating about the rotor at the same longitudinal location within the respective primary and secondary reduction chambers 40, 50 of the hammermill 10, the sideways motion of the particulate material being struck by the hammer 90 causes that particulate material to move longitudinally along the housing 20 relative to the longitudinally-stationary hammer. That is, the longitudinal direction in FIGS. 8A–8C is the direction that the two arrows in FIG. 8C are pointed. Accordingly, the pitch or angle of the tapered side edge 95 of the impact end 92 in FIGS. 8B and 8C relative to the body/shank of the hammer (or relative to the longitudinal axis of the housing 20) has two interrelated functions: (1) to vary the degree to which the particulate material being processed is reduced/shredded; and (2) to affect the speed and direction that the particulate material being processed flows longitudinally through the hammermill 10 (i.e., strong centrifugal forces hold the particulate material towards the attrition impact plates 75 of the hammermill 10 which allows the particulate material to be "plowed" downstream through the housing 20).

Further, as noted above, the particulate materials may be urged downstream toward the discharge end 24 of the housing 20 through the cooperative interaction of the side edges 95 of the impact end 92 of the hammers and the male protrusions (or female depressions) formed in the attrition impact plates 75. For example, if a male protrusion 78 having a triangle shape is formed on the attrition impact plate and, as in FIG. 8A, the impact end of the hammer 90 has a square shape, in which the first width of the impact end is substantially the same as the second width, a "square" side edge 95 would come into proximity to the "tapered" side of the triangle-shaped male protrusion which would effect the "scissoring" action while contacting the particulate material being reduced. The "scissoring" action would impart a force vector that would urge the particulate material downstream. Thus, as a result of so being struck, there would be sideways movement of the particulate material even though the impact end 92 of the hammer 90 does not have a tapered side edge 95. It is preferred that the side edge 95 of the impact end 92 be tapered to some degree in order to encourage the efficiency of the downstream movement of the particulate material imparted by the hammers 90.

As will be appreciated, there are numerous interrelated factors that can affect the rate of longitudinal movement of the particulate material through the hammermill 10, including the degree of taper of the impact ends of the hammers. Thus, it is contemplated that the impact ends of the hammers shown in FIGS. 8A–8C will be interchangeable on a single hammermill 10, making one hammermill 10 structure appropriate to process different types of materials or to reduce a given material to a different degree/size simply by changing the impact ends of the hammers. One skilled in the art will appreciate that the respective configuration of impact ends of the hammers do not need to be consistent throughout the machine and, for example, may vary from row to row along the rotor assembly 30.

Figure 1B:
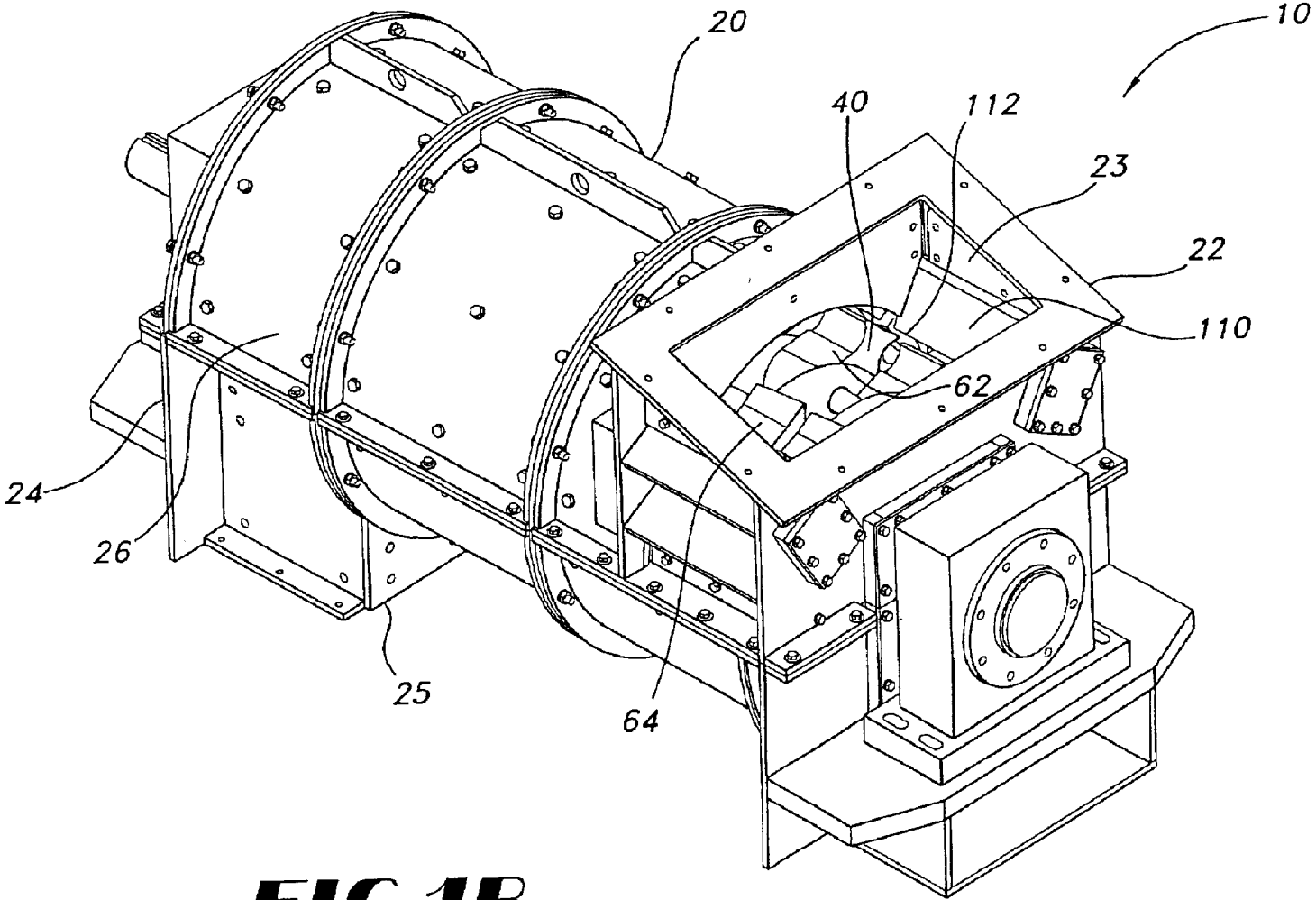
FIG. 1B is a second perspective view of the present invention.
Figure 2:
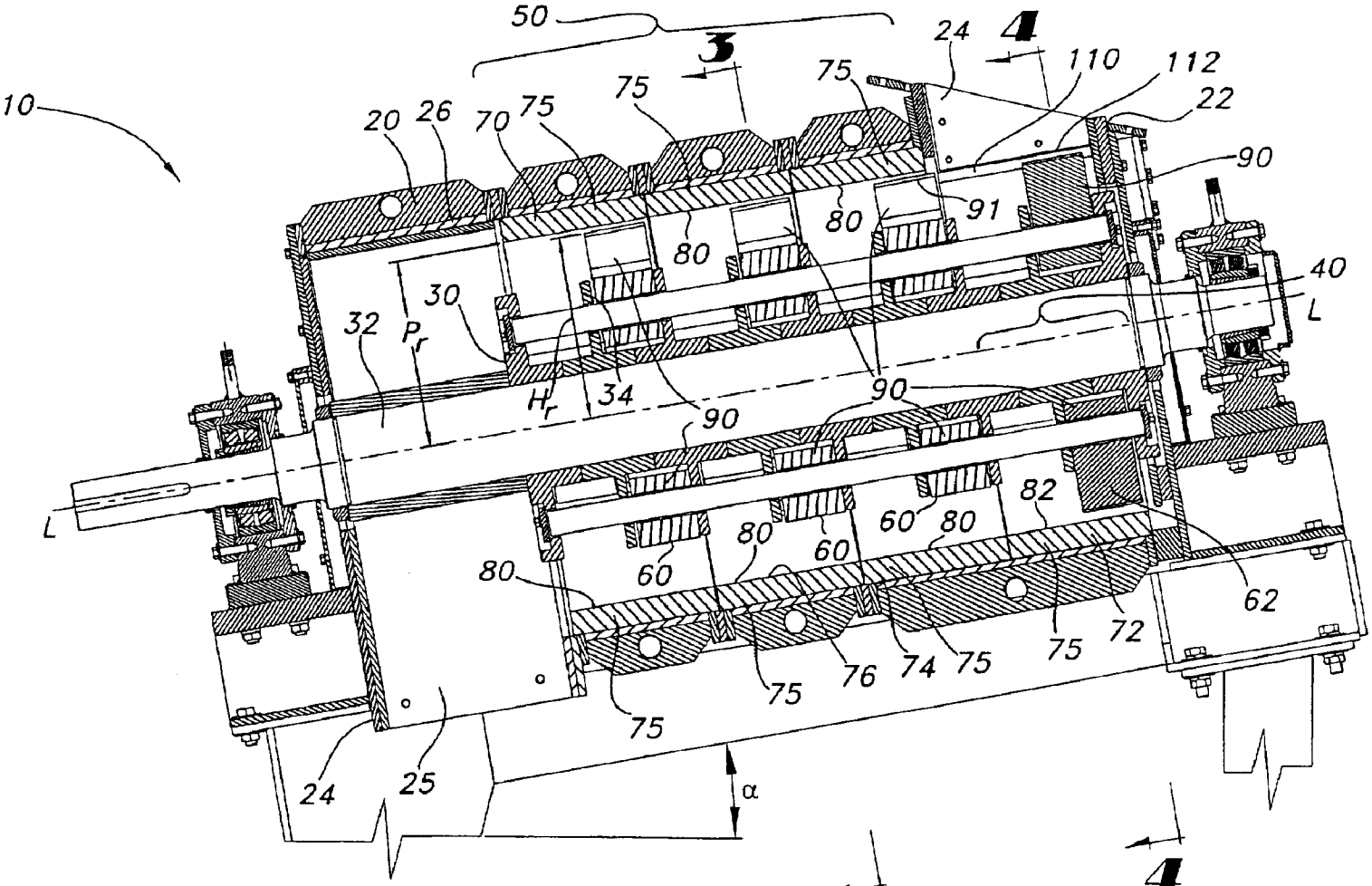
FIG. 2 is a side cross-sectional view of an exemplary embodiment of the present invention.
Figure 3:
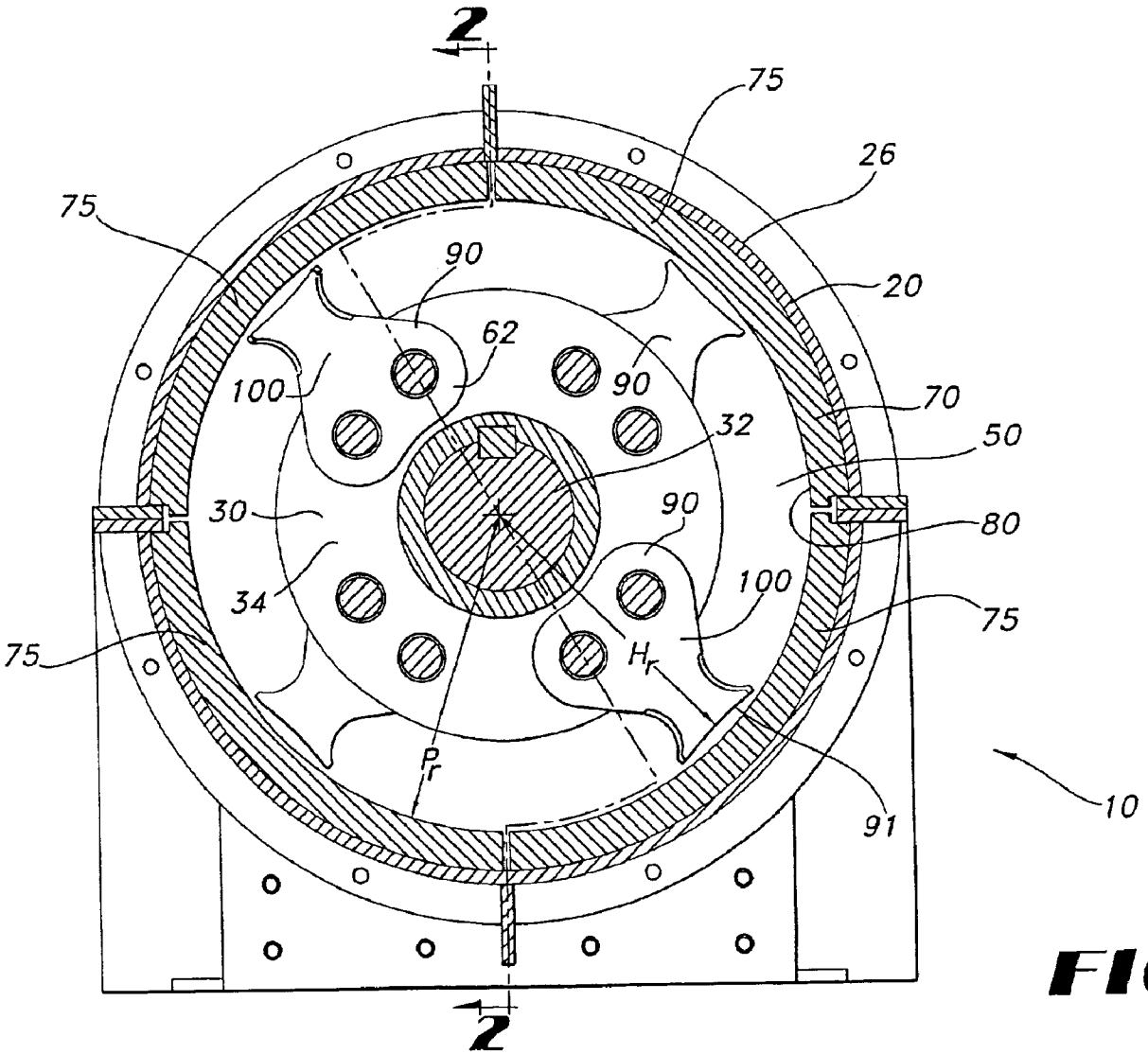
FIG. 3 is a cross-sectional view taken along line 3—3 of FIG. 1 showing a first plurality of hammers and a first attrition plate assembly in a secondary reduction chamber of the housing.
Figure 4:
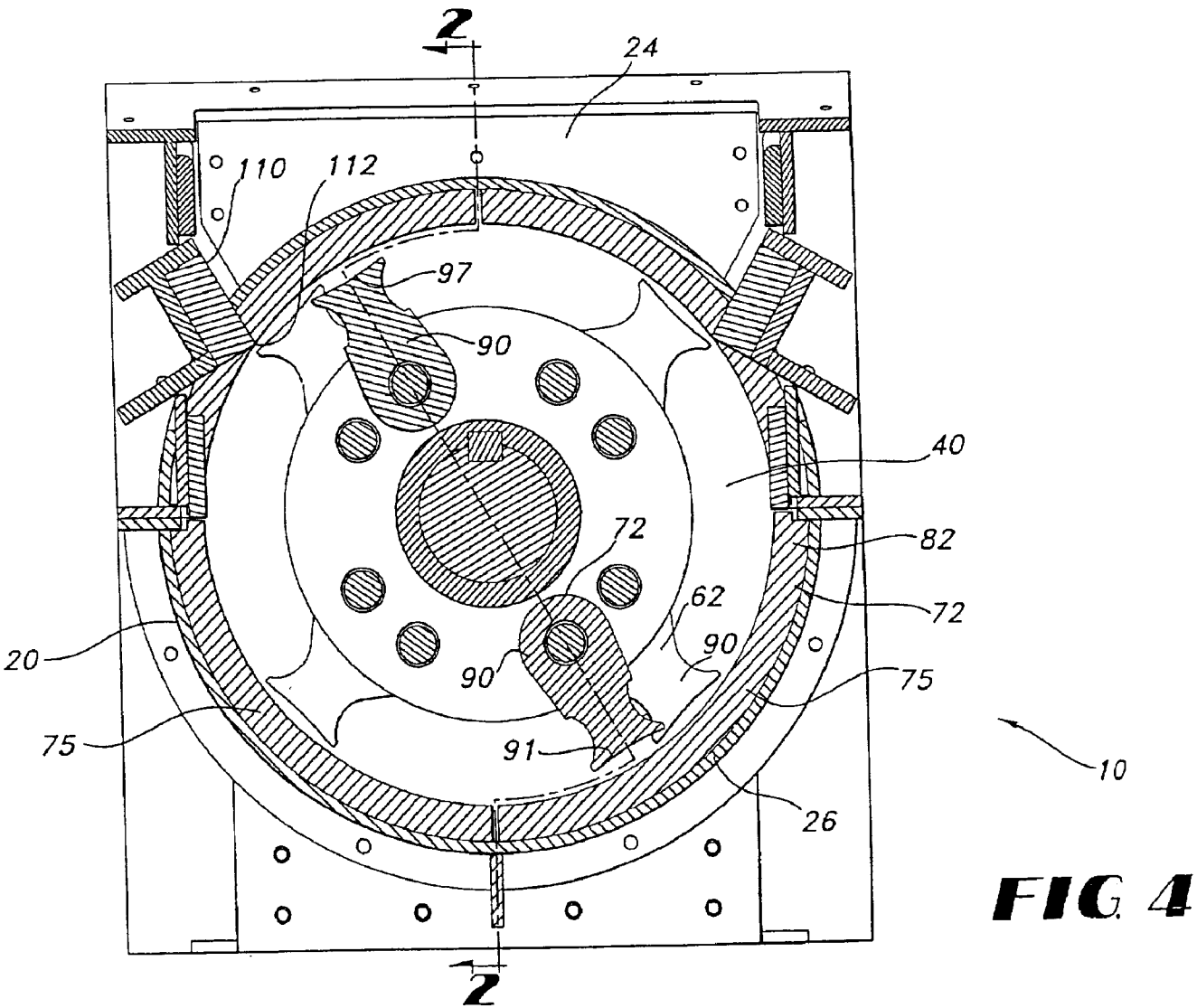
FIG. 4 is a cross-sectional view taken along line 4—4 of FIG. 1 showing a second plurality of hammers and a second attrition plate assembly in a primary reduction chamber of the housing.

Referring now to FIGS. 1A–2, to aid in reducing larger sized particulate materials entering the inlet opening 23 of the housing 20, the hammermill 10 of the present invention may also include at least one breaker plate 110 mounted proximate the inlet opening 23 of the housing 20. For reversible operation of the hammermill, it is preferred that a pair of opposed breaker plates 110 be mounted proximate the inlet opening 23 at the respective edges of the primary reduction chamber 40. Each breaker plate 110 has an elongate impact edge 112 which is preferably oriented substantially co-axial to the longitudinal axis of the housing 20. The breaker plate serves to absorb the impact of the initial reduction of large scale particulate materials to a manageable size before entering the hammer circle. In use, smaller pieces of particulate materials are pulled into the hammer circle immediately while the larger—and especially longer—pieces arc reduced while entering the hammermill 10. Reducing the larger and longer pieces against the breaker plate 110 decreases the horsepower needed to overcome the applied shock loads.

The hammermill 10 may also include an intake chute 120, in which particulate materials to be reduced are fed via the intake chute 120 through the inlet opening 23 in the housing 20 so that the oversized particulate material enters the housing 20 at a specific longitudinal location of the hammermill 10. The intake chute 120 is shown inclined so that oversized particulate material fed into the interior of the hammermill 10 has a point of discharge from the intake chute 120 that is generally level with the extended tips 91 of the hammers forming the second plurality of hammers 62. Stated differently, the oversized particulate material entering the hammermill 10 travels or slides down the inclined intake chute so that its point of discharge is level with the impact ends of the second plurality of hammers 62.

As shown, the bottom edges of the intake chute 120 are directed to be oriented inwardly. Preferably, the intake chute 120 is shown to be substantially U-shaped in side view so that the particulate materials are directed toward the centerline of the rotor assembly 30. Thus, the particulate materials entering the hammermill 10 via the intake chute, accordingly, are preferably not directed to be immediately processed by the hammers on their upswing. That is, the present design minimizes the likelihood of entering materials being ejected or thrown from the hammermill 10 (i.e., fly back of material).

Figure 9:
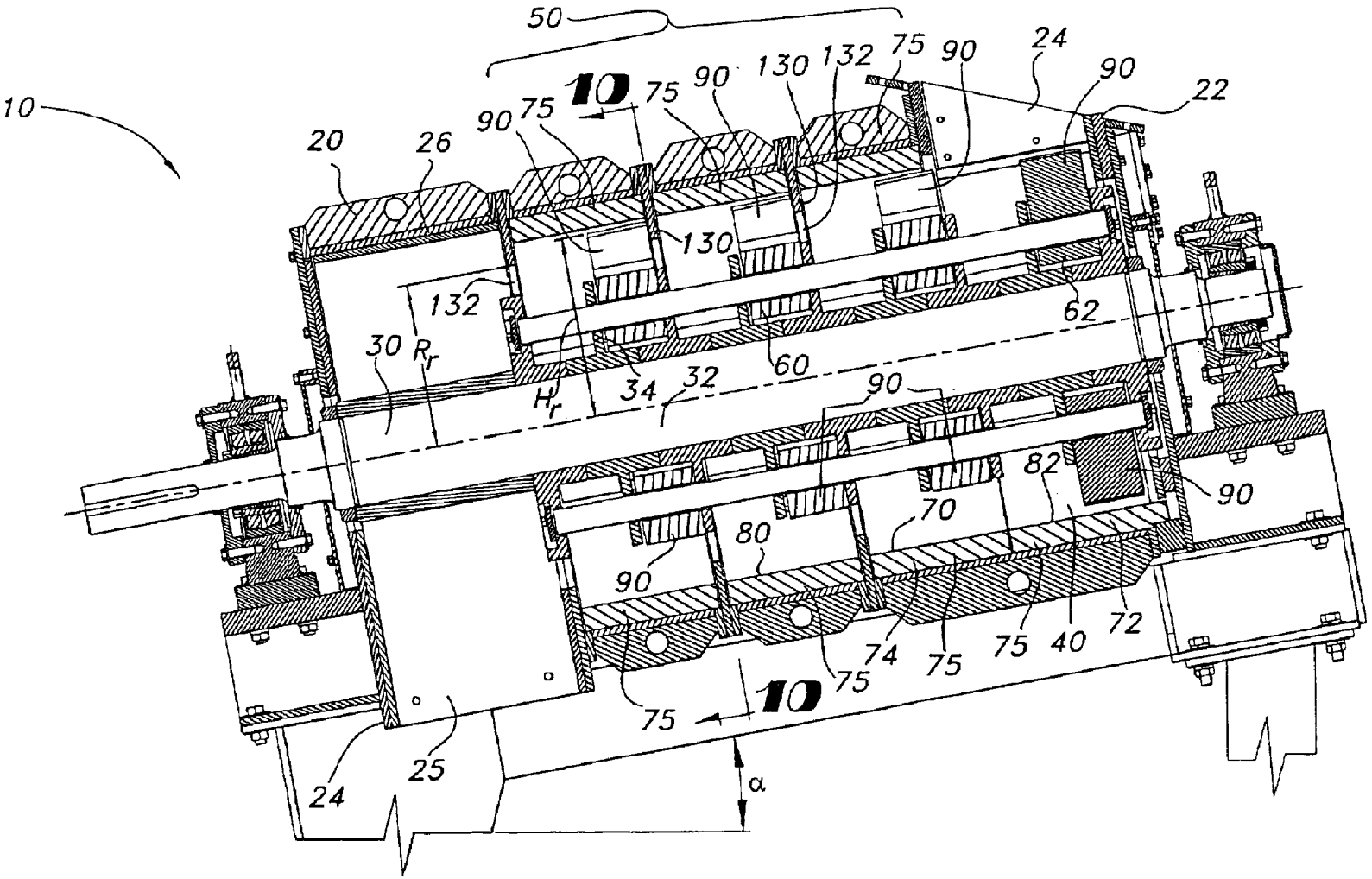
FIG. 9 is an cross-sectional view of an alternate embodiment of the hammermill of FIG. 2 that includes two rings used to impede the flow of particulate materials as they move longitudinally through the hammermill.
Figure 10:
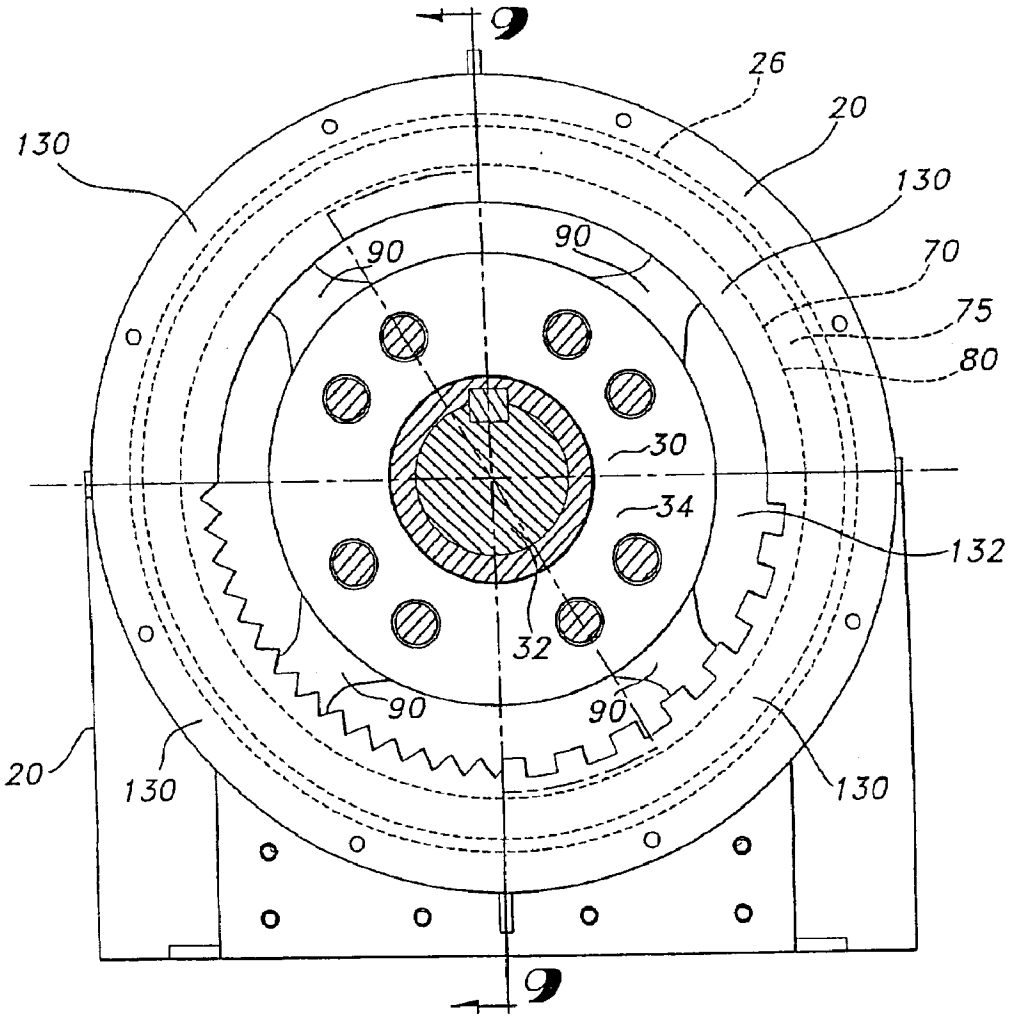
FIG. 10 is an end view taken along line 10—10 of FIG. 9 showing an exemplary ring, in which the illustrated ring includes three alternate edge consructions, namely, a solid ring, a saw-tooth ring, and a gap-tooth ring design.

Another aspect of the present invention shown in FIGS. 9 and 10 is the use of an annular "ring" 130 to slow the passage or flow of materials between the inlet opening 23 and the discharge opening 25 of the hammermill 10. The cross-sectional view shown in FIG. 9 illustrates a plurality of disks 34 circumscribing the rotor assembly 30, and, as is known in the art, the hammers 90 directly or indirectly connect to the disks 34. Each annular ring 130 is connected to and extends inwardly from the sidewall 26 of the housing 20 toward the rotor assembly. Preferably, the edge of the ring 130 is spaced from the circumferential edge of one disk to define a gap 132 between the ring 130 and the disk in which particulate material must pass to proceed downstream to the discharge end 24.

In use, the rings 130, which are better shown by the exemplary embodiment in FIG. 10, extend 360° about the rotor assembly 30 and preferably extend inwardly into the interior of the housing 20 so that they have a radius of curvature $R_r$ about the longitudinal axis of the housing 20 that is less than the hammer rotation radius. That is, the outer circumference or edge of the ring preferably extends between the impact ends of adjacent extended hammers. As one skilled in the art will appreciate, the rings 130 thus "dam" or impede the longitudinal flow of particulate materials through the housing 20. The result of including the rings 130 in the hammermill 10 is that the particulate material being processed reticulate or are retained longer within the housing 20 of the hammermill 10 and, accordingly, this longer retention time results in more comminutation or size reduction of the particulate material.

It is further contemplated that variations will exist in both the number and the design of the rings 130 used within the hammermill 10, as desired. For example, although FIG. 9 shows two rings, other embodiments are contemplated using zero, one, and three or more rings, which may vary based on the type of particulate materials being processed, the degree of reduction desired, and the mean or median time for particulate materials to be processed without the rings. Also, as shown in FIG. 10, the rings 130 can have different designs. For example, the top half of the ring is shown as a solid ring, which is one example. In comparison, the right lower quadrant shows a gap-tooth ring and the left lower quadrant shows a saw-tooth ring. These different ring examples have different attributes in terms of reduction of materials and retention times.

Another contemplated method of varying the retention time of the particulate material being processed by the hammermill 10 is to incline the hammermill 10 along its longitudinal length relative to a ground surface, such as, for example, a substantially horizontal surface. That is, the hammermill 10 of the present invention is contemplated being used or positioned parallel to or at a non-parallel angle $\alpha$ with respect to a horizontal surface. For example, as shown in FIG. 2, the longitudinal axis of the hammermill 10 is oriented at a 10° angle relative to the horizontal surface. Other angles $\alpha$ are also contemplated, such as from between 0° to 20° , more preferably from between −10° to 30°, and still more preferably from between −30° to 40°. The hammermill 10 may also have an adjustable or a variable angular orientation, i.e., the hammermill 10 can be oriented at one of a plurality of different angles, depending on the material being processed and the degree to which it is desired to reduce that material.

In considering the operations of the hammermill 10 of the present invention, one skilled in the art will appreciate that the size and type of particulate material being processed may dictate conditions such as speed, the number of hammers 90, and the horsepower necessary to effectively and efficiently operate the hammermill 10. These design parameters can be calculated using engineering equations, but more commonly the parameters are determined empirically by trial-and-error testing.

In the hammermill 10 of the present invention, the rate that materials are processed and move longitudinally through the housing 20 from its inlet end 22 to discharge end 24 may be controlled by: (1) the speed of the rotor assembly 30; (2) the length of the rotor assembly 30 and the number of hammers 90 connected thereto; (3) the angle of the hammermill 10 relative to horizontal; (4) the presence of discontinuous surfaces on the attrition impact plates 75; (5) the taper or bevel of the impact ends 92 of the hammers; and (6) the inclusion of rings 130 within the housing 20. These ways to control the rate of particulate material flow can all be varied independently or collectively in designing and operating the hammermill 10. One skilled in the art will further appreciate that many of these control features or parameters may be varied after the hammermill 10 has been manufactured—and even operated—including the taper of the impact ends 92 of the hammer, the angle of the hammermill 10 relative to horizontal, the presence of discontinuous surfaces on the attrition impact plates 75, and the inclusion of rings 130 within the housing 20 of the hammermill 10. The present invention, accordingly, provides distinct advantages over prior art systems because the known hamrmernill 10s cannot be modified as efficiently to process different particulate materials or the same particulate material to a different product graduation range. One skilled in the art will also appreciate that the present invention can be used for performing numerous applications in different industries.

The hammermill 10 of the present invention is more efficient with lower horsepower requirements than a unit not employing the features of the present invention. Because of the higher reduction ratio of the present invention, the hammermill 10 can operate at lower revolutions per minute ("RPM"), which translates into less wear on the components. The higher reduction ration also allows smaller units to perform a given task and to produce a narrower finished product graduation range. It is additionally contemplated that the hammennill 10 of the present invention will be easily accessible for service due to its size and construction, have good tramp metal protection, and have machine tool, fabrication welding, and assembly requirements that fit into existing line of equipment. Moreover, it is also contemplated that existing units can be expanded to meet future requirements for product changes on capacity issues.

The hammermill 10 of the present invention is easily reversible by reversing the direction of the rotor assembly 30 and the connected hammers 90. The advantage of such a reversible design is that it allows operations to occur longer between shutdowns because, for example, as the leading side edges 95 of the impact ends of the hammers wear during normal operations, they would need to be replaced; however, in the present invention, the trailing side edges 95 of the hammers are not worn. For example, if the side edges 95 have two impact edges which are mirror images of one another, the hammermill 10 will operate the same if the direction of the rotor assembly 30 is reversed. The resulting reversal in the rotation of the hammers prolongs the life of the hammers as well as reducing wear on other components (such as the attrition impact plates 75 in which a different portion of the surface of the plate may create the "scissors" action with the reversed hammer) and, accordingly, there may be longer durations of operations between maintenance and repair shutdowns.

Because the rotor assembly 30 of the present invention may be reversed, it is contemplated that the hammers may provide a substantially identical product graduation range (if the side edges 95 of the impact ends 92 of the hammers are mirror images of each other) or to achieve different results. For example, the degree of taper on one side of the impact end 92 of the hammer when the rotor turns clockwise may be blunt as shown in FIG. 8A, and the impact end 92 may be beveled on its opposite side edge 95 as shown in FIG. 8C. Thus, operating the rotor assembly 30 to turn clockwise will cause a lower reduction to a given particulate material than reversing the operations because, when rotating counterclockwise, the tapered side surface will move that particulate material longitudinally through the housing 20 faster and result in a lower retention/processing duration. As one skilled in the art will thus appreciate, there are other combinations of the impact ends of the hammers that can result in processing the same particulate material to the same or different product graduation ranges or to process different particulate materials that is simply obtained by reversing the direction of the rotor.

Although the illustrative embodiments of the present disclosure have been described herein with reference to the accompanying drawings, it is to be understood that the disclosure is not limited to those precise embodiment, and that various other changes and modifications may be affected therein by one skilled in the art without departing from the scope of spirt of the disclosure. All such changes and modifications are intended to be included within the scope of the disclosure as defined by the appended claims.

What is claimed is:

1. A hammermill for reducing oversized particulates to desired sized particulates, comprising:

a housing with an inlet end for receiving oversized particulates and a discharge end for exiting desired sized particulates, the housing defining a longitudinal axis;

a rotor assembly disposed within the housing for rotation about the longitudinal axis of the housing;

a first plurality of hammers coupled to the rotor assembly, the first plurality of hammers disposed intermediate the inlet end and the discharge end of the housing, each hammer of the first plurality of hammers being spaced from an adjacent hammer of the first plurality of hammers along the longitudinal axis and positioned at substantially at a right angle to the adjacent hammer;

a second plurality of hammers coupled to the rotor assembly, the second plurality of hammers disposed proximate the inlet end of the housing and adjacent the first plurality of hammers;

a first attrition plate assembly having a generally circular configuration and secured within the housing intermediate the inlet end and the discharge end of the housing, wherein a least a portion of each hammer of the first plurality of hammers closely overlies a portion of the first attrition plate assembly so that the hammers of the first plurality of hammers cooperate with the first attrition plate assembly; and a second attrition plate assembly having a generally semi-circular configuration and secured within the housing adjacent the inlet end of the housing and the first attrition plate assembly, wherein a least a portion of each hammer of the second plurality of hammers closely overlies a portion of the second attrition plate assembly so that the hammers of the second plurality of hammers cooperate with the second attrition plate assembly, wherein each of the respective first and second attrition plate assemblies comprises a plurality of attrition impact plates, each attrition impact plate having a curvilinear inner surface, and wherein at least two attrition impact plates of the first attrition plate assembly form a substantially continuous work surface having a generally cylindrical shape that encloses the first plurality of hammers.

2. The hammermill of claim 1, further comprising at least one breaker plate mounted proximate the inlet end of the housing for initial reduction of the oversized particulates.

3. The hammermill of claim 2, wherein the breaker plate has an impact edge, and wherein the impact edge is co-axial with the rotor assembly.

4. The hammermill of claim 1, wherein each hammer of the first plurality of hammers comprises a fixed hammer.

5. The hammermill of claim 1, wherein each hammer of the first plurality of hammers is selected from a group consisting of fixed hammers, swing hammers, or a combination thereof.

6. The hammermill of claim 1, wherein each hammer of the second plurality of hammers comprises a swing hammer.

7. The hammermill of claim 1, wherein each hammer of the second plurality of hammers is selected from a group consisting of fixed hammers, swing hammers, or a combination thereof.

8. The hammermill of claim 1, wherein each hammer of the first and second plurality of hammers has an impact end, the impact end having a proximal end, a spaced distal end, and a pair of opposing side edges extending between the proximal and distal ends, at least one of the side edges defining an impact edge extending for at least a portion of the side edge.

9. The hammermill of claim 8, wherein each hammer is positioned so that at least a portion of the proximal end of the hammer faces toward the inlet end of the housing.

10. The hammermill of claim 9, wherein the proximal end of the hammer has a first width extending between the respective side edges and the distal end of the hammer has a second width extending between the respective side edges.

11. The hammermill of claim 10, wherein the first width is substantially the same as the second width.

12. The hammermill of claim 10, wherein the first width is greater than the second width so that at least one of the side edges is tapered from the proximal end to the distal end.

13. The hammermill of claim 8 or 12, wherein each of the side edges is tapered from the proximal end to the distal end.

14. The hammermill of claim 8, wherein the impact end of each hammer has a bottom surface extending between the side edges, at least a portion of the bottom surface defining a concave shape.

15. The hammermill of claim 1, wherein the inner surface of each attrition impact plate defines at least one male protrusion extending from the inner surface, each male protrusion defining a geometric shape.

16. The hammermill of claim 1, wherein the inner surface of each attrition impact plate defines at least one female depression in the inner surface, each female depression protrusion having a geometric shape.

17. The hammermill of claim 15 or 16, wherein the geometric shape comprises a circle, an oval, a triangle, a trapezoid, a rectangle, a square, an arrow, and combinations thereof.

18. The hammermill of claim 15, wherein the geometric shape is a triangle having an apex and a base, the apex of the triangle facing toward a portion of the discharge end of the housing and at least a portion of the base of the triangle opposed to a portion of the inlet end of the housing.

19. The hammermill of claim 15, wherein each attrition impact plate has an arcuate length, and wherein the attrition impact plate has a plurality of parallel bars that are spaced apart in the length dimension.

20. A hammermill comprising:

a housing having an inlet end, a discharge end, a sidewall extending between the inlet end and the discharge end, and a longitudinal axis, the sidewall of the housing defining an enclosed work space, an inlet opening being defined in the sidewall of the housing proximate the inlet end of the housing, a discharge opening being defined in the sidewall of the housing proximate the discharge end of the housing, the inlet opening being disposed above the longitudinal axis of the housing and the discharge opening being disposed below the longitudinal axis of the housing;

a rotor assembly disposed within the housing for rotation about the longitudinal axis of the housing;

a first plurality of hammers coupled to the rotor assembly and disposed in the enclosed work space, each hammer of the first plurality of hammers being spaced from an adjacent hammer of the first plurality of hammers along the longitudinal axis and positioned at substantially at a right angle to the adjacent hammer;

a second plurality of hammers coupled to the rotor assembly, the second plurality of hammers disposed proximate the inlet end of the housing and adjacent the first plurality of hammers; and a first attrition plate assembly having a generally circular configuration secured to the sidewall within the enclosed work space of the housing, the first attrition plate assembly arranged such that at least a portion of each hammer of the first plurality of hammers is spaced from and overlies a portion of the first attrition plate assembly, wherein the first attrition plate assembly defines a substantially continuous first work surface having a generally cylindrical shape in the enclosed work space.

21. The hammermill of claim 20, wherein each hammer has an outer tip which defines a hammer rotation radius about the longitudinal axis of the housing.

22. The hammermill of claim 21, wherein the first work surface has has a radius of curvature about the longitudinal axis of the housing that is greater than the hammer rotation radius, and wherein the first attrition plate assembly is arranged such that at least a portion of the outer tip of each hammer is spaced from at least a portion of the first work surface in the range of from 0.01 to 3.0 inch.

23. The hammermill of claim 20, wherein the sidewall has a substantially uniform curvature.

24. The hammermill of claim 23, wherein the sidewall is cylindrical.

25. The hammermill of claim 20, wherein at least a portion of the second plurality of hammers underlies the inlet opening.

26. The hammermill of claim 20, further comprising a second attrition plate assembly having a generally semi-circular configuration and secured within the housing adjacent the first attrition plate assembly and the inlet opening of the housing, wherein at least a portion of each hammer of the second plurality of hammers is spaced from and overlies a portion of the second attrition plate assembly.

27. The hammermill of claim 25, further comprising at least one breaker plate mounted proximate the inlet opening of the housing.

28. The hammermill of claim 27, wherein each breaker plate has an impact edge, and wherein the impact edge is substantially co-axial to the longitudinal axis of the housing.

29. The hammermill of claim 27, comprising a pair of opposed breaker plates.

30. The hanunermnill of claim 20, wherein each hammer of the first plurality of hammers comprises a fixed hammer.

31. The hammermill of claim, 20, wherein each hammer of the first plurality of hammers is selected from a group consisting of fixed hammers, swing hammers, or a combination thereof.

32. The hammermill of claim 20, wherein each hammer of the second plurality of hammers is selected from a group consisting of fixed hammers, swing hammers, or a combination thereof.

33. The hammermill of claim 20, wherein each hammer of the first and second plurality of hammers has an impact end, the impact end having a proximal end, a spaced distal end, and a pair of opposing side edges extending between the proximal and distal ends, at least one of the side edges defining an impact edge extending for at least a portion of the side edge.

34. The hammermill of claim 23, wherein each hammer is positioned so that at least a portion of the proximal end of the hammer faces toward the inlet end of the housing.

35. The hammermill of claim 34, wherein the proximal end of the hammer has a first width extending between the respective side edges and the distal end of the hammer has a second width extending between the respective side edges.

36. The hammermill of claim 35, wherein the first width is substantially the same as the second width.

37. The hammermill of claim 35, wherein the first width is greater than the second width so that at least one of the side edges is tapered from the proximal end to the distal end.

38. The hammermill of claim 33 or 35, wherein each of the side edges is tapered from the proximal end to the distal end.

39. The hammermill of claim 33, wherein the impact end of the hammer has a bottom surface extending between the side edges, at least a portion of the bottom surface defining a concave shape.

40. The hammermill of claim 26, wherein each of the respective first and second attrition plate assemblies comprises a plurality of attrition impact plates.

41. The hammermill of claim 40, wherein each attrition impact plate has a curvilinear inner surface.

42. The hammermill of claim 41, wherein at least two attrition impact plates are positioned so that the curvilinear inner surface of the attrition impact plates form the substantially continuous first work surface.

43. The hammermill of claim 42, wherein the continuous first work surface encloses the first plurality of hammers.

44. The hammermill of claim 41, wherein the inner surface of each attrition impact plate defines at least one male protrusion extending from the inner surface, each male protrusion defining a geometric shape.

45. The hammermill of claim 41, wherein the inner surface of each attrition impact plate defines at least one female depression in the inner surface, each female depression protrusion defining a geometric shape.

46. The hammermill of claim 44 or 45, wherein the geometric shape comprises a circle, an oval, a triangle, a trapezoid, a rectangle, a square, an arrow, and combinations thereof.

47. The hammermill of claim 44, wherein the geometric shape is a triangle having an apex, the apex of the triangle extending toward the discharge end of the housing parallel to the longitudinal axis of the housing.

48. The hammermill of claim 44, wherein each attrition impact plate has an arcuate length, and wherein the attrition impact plate has a plurality of parallel bars that are spaced apart in the length dimension of the attrition impact plate and extend parallel to the longitudinal axis of the housing.

49. The hammermill of claim 20, wherein the rotor assembly has a rotatable shaft on the axis and support means extending radially from the shaft, and wherein the hammers are operatively coupled to the support means.

50. The hammermill of claim 20, wherein the housing rests on a ground surface, and wherein the longitudinal axis of the housing is positioned at an angle in the range of from −30° to 40° with respect to the ground surface.

51. A hammermill comprising:

a housing having an inlet end, a discharge end, a sidewall extending between the inlet end and the discharge end, a longitudinal axis, a primary reduction chamber and an adjoining secondary reduction chamber, the sidewall proximate the inlet end of the housing defining an inlet opening, wherein, in the secondary reduction chamber, the sidewall of the housing defines an enclosed work space, and wherein, in the primary reduction chamber, the sidewall and the inlet opening define a partially enclosed work space;

a rotor assembly disposed within the housing for rotation about the longitudinal axis of the housing;

a plurality of hammers coupled to the rotor assembly and disposed in both the primary and secondary reduction chambers, respectively, each hammer of the plurality of hammers having an impact end, the impact end having a proximal end, a spaced distal end, and a pair of opposing side edges extending between the proximal and distal ends, at least one of the side edges defining an impact edge extending for at least a portion of the side edge, the proximal end of the hammer having a first width extending between the respective side edges and the distal end of the hammer having a second width extending between the respective side edges, wherein the first width being greater than the second width so that at least one of the side edges is tapered from the proximal end to the distal end; and an attrition plate assembly secured to the sidewall within the primary and secondary reduction chambers, respectively, the attrition plate assembly arranged such that the hammers are spaced from and overlie a portion of the attrition plate assembly, wherein a portion of the attrition plate assembly secured to the sidewall within the secondary reduction chamber has a generally circular configuration and defines a substantially continuous work surface having a generally cylindrical shape;

wherein each hammer of the plurality of hammers is spaced from an adjacent hammer of the plurality of hammers along the longitudinal axis and is positioned at substantially at a right angle to the adjacent hammer, and wherein each hammer of the plurality of hammers is positioned so that at least a portion of the proximal end of the hammer faces toward the inlet end of the housing.

52. The hammermill of claim 51, wherein a portion of the attrition plate assembly secured to the sidewall within the primary reduction chamber of the housing has a generally semi-circular configuration and defines a discontinuous work surface.

53. The hammermill of claim 51, wherein each hammer has an outer tip which defines a hammer rotation radius about the axis.

54. The hammermill of claim 53, wherein the attrition plate assembly defines a work surface in the enclosed and the partially enclosed work space, respectively, having a radius of curvature about the axis that is greater than the hammer rotation radius, and wherein the attrition plate assembly is arranged such that at least a portion of the outer tip of each hammer is spaced from at least a portion of the work surface in the range of from 0.01 to 3.0 inch.

55. The hammermill of claim 51, wherein the sidewall has a substantially uniform curvature.

56. The hammermill of claim 55, wherein the sidewall is cylindrical.

57. The hammermill of claim 51, wherein the inlet opening is positioned above the longitudinal axis of the housing.

58. The hammermill of claim 57, wherein a discharge opening is defined in the sidewall of the housing proximate the discharge end of the housing below the longitudinal axis of the housing.

59. The hammermill of claim 57, wherein at least a portion of the plurality of hammers underlies the inlet opening.

60. The hammermill of claim 59, further comprising at least one breaker plate mounted proximate the inlet opening of the housing.

61. The hammermill of claim 60, wherein each breaker plate has an impact edge, and wherein the impact edge is substantially co-axial to the longitudinal axis of the housing.

62. The hammermill of claim 61, comprising a pair of opposed breaker plates.

63. The hammermill of claim 51, wherein each hammer of the plurality of hammers comprises a fixed hammer.

64. The hammermill of claim 51, wherein each hammer of the plurality of hammers comprises a swing hammer.

65. The hammermill of claim 51, wherein each hammer of the plurality of hammers is selected from a group consisting of fixed hammers, swing hammers, or a combination thereof.

66. The hammermill of claim 51, wherein each hammer of the plurality of hammers that is disposed in the primary reduction chamber comprises a swing hammer, and wherein each hammer of the plurality of hammers that is disposed in the secondary reduction chamber is selected from a group consisting of fixed hammers, swing hammers, or a combination thereof.

67. The hammermill of claim 51, wherein the first width is substantially the same as the second width.

68. The hammermill of claim 51, wherein each of the side edges is tapered from the proximal end to the distal end.

69. The hammermill of claim 51, wherein the attrition plate assembly comprises a plurality of adjoining attrition impact plates.

70. The hammennill of claim 69, wherein each attrition impact plate has a curvilinear inner surface.

71. The hammermill of claim 70, wherein at least two adjoining attrition impact plates are positioned so that the curvilinear inner surface of the attrition impact plates form the substantially continuous work surface within the secondary reduction chamber.

72. The hammermill of claim 51, wherein the continuous work surface encloses the hammers disposed in the secondary reduction chamber.

73. The hammermill of claim 70, wherein the inner surface of each attrition impact plate defines at least one male protrusion extending outwardly therefrom, each male protrusion defining a geometric shape.

74. The hammermill of claim 70, wherein the inner surface of each attrition impact plate defines at least one female depression in the inner surface, each female depression protrusion defining a geometric shape.

75. The hammermill of claim 73 or 74, wherein the geometric shape comprises a circle, an oval, a triangle, a trapezoid, a rectangle, a square, an arrow, and combinations thereof.

76. The hammermill of claim 73, wherein the geometric shape is a triangle having an apex, the apex of the triangle extending toward the discharge end of the housing parallel to the longitudinal axis of the housing.

77. The hammermill of claim 73, wherein each attrition impact plate has an arcuate length, and wherein the attrition impact plate has a plurality of parallel bars that are spaced apart in the length dimension and extend parallel to the longitudinal axis of the housing.

78. The hammermill of claim 51, wherein the rotor assembly has a rotatable shaft on the longitudinal axis of the housing and support means extending radially from the shaft, and wherein the hammers are operatively coupled to the support means.

79. The hammermill of claim 51, wherein the housing rests on a ground surface, and wherein the longitudinal axis of the housing is inclined at an angle in the range of −30° to 40° with respect to the ground surface.

80. A hammermill comprising:

a housing having an inlet end, a discharge end, a sidewall extending between the inlet end and the discharge end, a longitudinal axis, a primary reduction chamber and an adjoining secondary reduction chamber, the sidewall proximate the inlet end of the housing defining an inlet opening, wherein, in the secondary reduction chamber, the sidewall of the housing defines an enclosed work space, and wherein, in the primary reduction chamber, the sidewall and the inlet opening define a partially enclosed work space;

a rotor assembly disposed within the housing for rotation about the longitudinal axis of the housing;

a plurality of hammers coupled to the rotor assembly and disposed in both the primary and secondary reduction chambers, respectively, each hammer having an impact end, the impact end having a proximal end, a spaced distal end, and a pair of opposing side edges extending between the proximal and distal ends, at least one of the side edges defining an impact edge that extends for at least a portion of the side edge, the impact edge being angled with respect to the longitudinal axis of the housing and facing downwardly toward the discharge end of the housing, wherein each hammer of the plurality of hammers is spaced from an adjacent hammer of the plurality of hammers along the longitudinal axis and is Positioned substantially at a right angle to the adjacent hammer; and a plurality of adjoining attrition impact plates secured to the sidewall within the primary and secondary reduction chambers, respectively, each attrition impact plate having a grinding surface and defining a curvilinear inner surface, the attrition impact plates arranged such that the hammers are spaced from and overlie a portion of the grinding surface of the attrition impact plates, wherein at least two adjoining attrition impact plates defines a substantially continuous work surface within the secondary reduction chamber, the continuous work surface having a generally cylindrical shape that encloses the hammers disposed in the secondary reduction chamber, whereby the hammers and the attrition impact plates cooperate to urge particulate material toward the discharge end of the housing.

81. The hammermill of claim 80, wherein the proximal end of the hammer has a first width extending between the respective side edges and the distal end of the hammer has a second width extending between the respective side edges.

82. The hammermill of claim 81, wherein the first width is greater than the second width so that at least one of the side edges is tapered from the proximal end to the distal end.

83. The hammermill of claim 82, wherein the grinding surface of each attrition impact plate defines at least one male protrusion extending outwardly therefrom, each male protrusion defining a geometric shape.

84. The hammermill of claim 82, wherein the inner surface of each attrition impact plate defines at least one female depression in the inner surface, each female depression protrusion defining a geometric shape.

85. The hammermill of claim 83 or 84, wherein the geometric shape is a triangle having an apex, the apex of the triangle extending toward the discharge end of the housing parallel to the longitudinal axis of the housing.

86. The hammermill of claim 83, wherein each attrition impact plate has an arcuate length, and wherein the attrition impact plate has a plurality of parallel bars that are spaced apart in the length dimension of the attrition impact plate and extend parallel to the longitudinal axis of the housing.

87. The hammermill of claim 80, wherein the housing rests on a ground surface, and wherein the longitudinal axis of the housing is inclined at an angle of between −10° to 20° with respect to the ground surface.

88. A hammermill, comprising:

a housing with an inlet end for receiving oversized particulates, a discharge end for exiting desired sized particulates, the housing defining a longitudinal axis;

a rotor assembly disposed within the housing for rotation about the longitudinal axis of the housing;

a first plurality of hammers coupled to the rotor assembly, the plurality of hammers disposed intermediate the inlet end and the discharge end of the housing, each hammer of the first plurality of hammers being spaced from an adjacent hammer of the first plurality of hammers along the longitudinal axis and positioned at substantially at a right angle to the adjacent hammer;

a second plurality of hammers coupled to the rotor assembly, the second plurality of hammers disposed proximate the inlet end of the housing and adjacent the first plurality of hammers; and a first attrition plate assembly having a generally circular configuration and secured within the housing intermediate the inlet end and the discharge end of the housing, the first attrition plate assembly forming a substantially continuous work surface within a portion of the housing, the continuous work surface having a generally cylindrical shape, wherein a least a portion of each hammer of the first plurality of hammers closely overlies a portion of the first attrition plate assembly and wherein the hammers of the first plurality of hammers cooperate with the first attrition plate assembly to form the desired sized particulates.

89. The hammermill of claim 88, further comprising a second attrition plate assembly having a generally semi-circular configuration and secured within the housing adjacent the inlet end of the housing and the first attrition plate assembly, wherein at least a portion of each hammer of the second plurality of hammers closely overlies a portion of the second attrition plate assembly;

whereby the hammers of the second plurality of hammers cooperate with the second attrition plate assembly.

90. The hammermill of claim 89, further comprising at least one breaker plate mounted proximate the inlet end of the housing for initial reduction of the oversized particulates.

91. The hammermill of claim 90, wherein the breaker plate has an impact edge, and wherein the impact edge is co-axial with the rotor assembly.

92. The hammermill of claim 88, wherein each hammer of the first plurality of hammers comprises a fixed hammer.

93. The hammermill of claim 88, wherein each hammer of the first plurality of hammers is selected from a group consisting of fixed hammers, swing hammers, or a combination thereof.

94. The hammermill of claim 89, wherein each of the respective first and second attrition plate assemblies comprises a plurality of attrition impact plates.

95. The hammermill of claim 94, wherein the attrition impact plates have a curvilinear inner surface.

96. The hammermill of claim 95, wherein at least two attrition impact plates are positioned so that the curvilinear inner surface of the first attrition impact plates form the substantially continuous work surface within a portion of the housing.

97. The hammermill of claim 96, wherein the continuous work surface encloses the first plurality of hammers.

98. The hammermill of claim 95, wherein the inner surface of each attrition impact plate defines at least one male protrusion extending from the inner surface, each male protrusion defining a geometric shape.

99. The hammermill of claim 95, wherein the inner surface of each attrition impact plate defines at least one female depression in the inner surface, each female depression protrusion having a geometric shape.

100. The hammermill of claim 98 or 99, wherein the geometric shape comprises a circle, an oval, a triangle, a trapezoid, a rectangle, a square, an arrow, and combinations thereof.

101. The hammermill of claim 98, wherein the geometric shape is a triangle having an apex and a base, the apex of the triangle facing toward a portion of the discharge end of the housing and at least a portion of the base of the triangle opposed to a portion of the inlet end of the housing.

102. The hammermill of claim 98, wherein each attrition impact plate has an arcuate length, and wherein the attrition impact plate has a plurality of parallel bars that are spaced apart in the length dimension.

103. A hammermill comprising:

a housing having an inlet end, a discharge end, a sidewall extending between the inlet end and the discharge end, and a longitudinal axis, the sidewall of the housing defining an enclosed work space, an inlet opening is defined in the sidewall of the housing proximate the inlet end of the housing, a discharge opening is defined in the sidewall of the housing proximate the discharge end of the housing, wherein the inlet opening is disposed above the longitudinal axis of the housing, and wherein the discharge opening is disposed below the longitudinal axis of the housing;

a rotor assembly disposed within the housing for rotation about the longitudinal axis of the housing;

a first plurality of hammers coupled to the rotor assembly and disposed in the enclosed work space, each hammer of the first plurality of hammers being spaced from an adjacent hammer of the first plurality of hammers along the longitudinal axis and positioned at substantially at a right angle to the adjacent hammer;

a second plurality of hammers coupled to the rotor assembly, the second plurality of hammers disposed proximate the inlet end of the housing and adjacent the first plurality of hammers;

a first attrition plate assembly having a generally circular shape secured to the sidewall within the enclosed work space of the housing, the first attrition plate assembly forming a substantially continuous work surface, the first attrition plate assembly arranged such that at least a portion of each hammer of the first plurality of hammers is spaced from and overlies a portion of the first attrition plate assembly; and a second attrition plate assembly having a generally semi-circular configuration and secured within the housing adjacent the first attrition plate assembly and the inlet opening of the housing, at least a portion of each hammer of the second plurality of hammers is spaced from and overlies a portion of the second attrition plate assembly, wherein each of the respective first and second attrition plate assemblies comprises a plurality of attrition impact plates, and wherein each attrition impact plate has a curvilinear inner surface.

104. The hammermill of claim 103, wherein each hammer has an outer tip which defines a hammer rotation radius about the longitudinal axis of the housing.

105. The hammermill of claim 103, wherein the first work surface has a radius of curvature about the longitudinal axis of the housing that is greater than the hammer rotation radius, and wherein the first attrition plate assembly is arranged such that at least a portion of the outer tip of each hammer is spaced from at least a portion of the first work surface in the range of from 0.01 to 3.0 inch.

106. The hammermill of claim 103, wherein the sidewall has a substantially uniform curvature.

107. The hammermill of claim 106, wherein the sidewall is cylindrical.

108. The hammermill of claim 103, wherein at least a portion of the second plurality of hammers underlies the inlet opening.

109. The hammermill of claim 108, further comprising at least one breaker plate mounted proximate the inlet opening of the housing.

110. The hammermill of claim 109, wherein each breaker plate has an impact edge, and wherein the impact edge is substantially co-axial to the longitudinal axis of the housing.

111. The hammermill of claim 109, comprising a pair of opposed breaker plates.

112. The hammermill of claim 103, wherein each hammer of the first plurality of hammers comprises a fixed hammer.

113. The hammermill of claim 103, wherein each hammer of the first plurality of hammers is selected from a group consisting of fixed hammers, swing hammers, or a combination thereof.

114. The hammermill of claim 103, wherein each hammer of the second plurality of hammers comprises a swing hammer.

115. The hammermill of claim 103, wherein each hammer of the second plurality of hammers is selected from a group consisting of fixed hammers, swing hammers, or a combination thereof.

116. The hammermill of claim 103, wherein each hammer of the first and second plurality of hammers has an impact end, the impact end having a proximal end, a spaced distal end, and a pair of opposing side edges extending between the proximal and distal ends, at least one of the side edges defining an impact edge extending for at least a portion of the side edge.

117. The hammermill of claim 116, wherein each hammer is positioned so that at least a portion of the proximal end of the hammer faces toward the inlet end of the housing.

118. The hammermill of claim 117, wherein the proximal end of the hammer has a first width extending between the respective side edges and the distal end of the hammer has a second width extending between the respective side edges.

119. The hammermill of claim 118, wherein the first width is substantially the same as the second width.

120. The hammermill of claim 118, wherein the first width is greater than the second width so that at least one of the side edges is tapered from the proximal end to the distal end.

121. The hammermill of claim 116 or 118, wherein each of the side edges is tapered from the proximal end to the distal end.

122. The hammermill of claim 116, wherein the impact end of the hammer has a bottom surface extending between the side edges, at least a portion of the bottom surface defining a concave shape.

123. The hammermill of claim 103, wherein at least two attrition impact plates are positioned so that the curvilinear inner surface of the attrition impact plates form the substantially continuous first work surface.

124. The hammermill of claim 123, wherein the continuous first work surface has a generally cylindrical shape and encloses the first plurality of hammers.

125. The hammermill of claim 103, wherein the inner surface of each attrition impact plate defines at least one male protrusion extending from the inner surface, each male protrusion defining a geometric shape.

126. The hammermill of claim 103, wherein the inner surface of each attrition impact plate defines at least one female depression in the inner surface, each female depression protrusion defining a geometric shape.

127. The hammermill of claim 125 or 126, wherein the geometric shape comprises a circle, an oval, a triangle, a trapezoid, a rectangle, a square, an arrow, and combinations thereof.

128. The hammermill of claim 125, wherein the geometric shape is a triangle having an apex, the apex of the triangle extending toward the discharge end of the housing parallel to the longitudinal axis of the housing.

129. The hammermill of claim 125, wherein each attrition impact plate has an arcuate length, and wherein the attrition impact plate has a plurality of parallel bars that are spaced apart in the length dimension of the attrition impact plate and extend parallel to the longitudinal axis of the housing.

130. The hammermill of claim 103, wherein the rotor assembly has a rotatable shaft on the axis and support means extending radially from the shaft, and wherein the hammers are operatively coupled to the support means.

131. The hammermill of claim 103, wherein the housing rests on a ground surface, and wherein the longitudinal axis of the housing is positioned at an angle in the range of from −30° to 40° with respect to the ground surface.

132. A hammermill comprising:

a housing having an inlet end, a discharge end, a sidewall extending between the inlet end and the discharge end, a longitudinal axis, a primary reduction chamber and an adjoining secondary reduction chamber, the sidewall proximate the inlet end of the housing defining an inlet opening, wherein, in the secondary reduction chamber, the sidewall of the housing defining an enclosed work space, and wherein, in the primary reduction chamber, the sidewall and the inlet opening define a partially enclosed work space;

a rotor assembly disposed within the housing for rotation about the longitudinal axis of the housing;

a plurality of hammers coupled to the rotor assembly and disposed in both the primary and secondary reduction chambers, respectively, each hammer of the plurality of hammers having an impact end, the impact end having a proximal end, a spaced distal end, and a pair of opposing side edges extending between the proximal and distal ends, at least one of the side edges defining an impact edge extending for at least a portion of the side edge, the impact end of the hammer has a bottom surface extending between the side edges, at least a portion of the bottom surface defining a concave shape; and an attrition plate assembly secured to the sidewall within the primary and secondary reduction chambers, respectively, the attrition plate assembly arranged such that the hammers are spaced from and overlie a portion of the attrition plate assembly.

133. The hammermill of claim 51, wherein the impact end of the hammer has a bottom surface extending between the side edges, at least a portion of the bottom surface defining a concave shape.

* * * * *